US008251242B2

(12) United States Patent
Vovan

(10) Patent No.: US 8,251,242 B2
(45) Date of Patent: Aug. 28, 2012

(54) TAMPER-EVIDENT CONTAINER WITH EXTENDED BAND

(75) Inventor: Terry Vovan, Upland, CA (US)

(73) Assignee: PWP Industries, Vernon, CA (US)

( * ) Notice: Subject to any disclaimer, the term of this patent is extended or adjusted under 35 U.S.C. 154(b) by 267 days.

(21) Appl. No.: 12/626,476

(22) Filed: Nov. 25, 2009

(65) Prior Publication Data

US 2010/0065567 A1 Mar. 18, 2010

Related U.S. Application Data

(63) Continuation-in-part of application No. 11/446,622, filed on Jun. 5, 2006, now Pat. No. 7,631,776, and a continuation-in-part of application No. 11/230,978, filed on Sep. 20, 2005, now Pat. No. 8,083,089.

(60) Provisional application No. 60/689,394, filed on Jun. 10, 2005, provisional application No. 60/698,736, filed on Jul. 13, 2005.

(51) Int. Cl.
*B65D 17/40* (2006.01)
*B65D 41/32* (2006.01)

(52) U.S. Cl. ..... 220/276; 220/266; 220/4.21

(58) Field of Classification Search ..... 220/260, 220/266, 270, 276, 4.21, 4.22, 4.26; 215/256, 215/901

See application file for complete search history.

(56) References Cited

U.S. PATENT DOCUMENTS

| | | | |
|---|---|---|---|
| 3,495,759 | A | 2/1970 | Bergstrom et al. |
| 3,572,579 | A | 3/1971 | Mueller et al. |
| 3,773,207 | A | 11/1973 | Dokoupil et al. |
| 3,836,039 | A | 9/1974 | Seiferth et al. |
| 3,860,148 | A | 1/1975 | Sherin |
| 3,870,219 | A | 3/1975 | Reisman |
| 3,941,248 | A | 3/1976 | Moser et al. |
| 4,006,839 | A | 2/1977 | Thiel et al. |
| 4,091,930 | A | 5/1978 | Buchner et al. |
| 4,113,136 | A | 9/1978 | Abbott |
| 4,150,748 | A | 4/1979 | Mueller |

(Continued)

FOREIGN PATENT DOCUMENTS

| | | |
|---|---|---|
| DE | 78 16 353 | 11/1978 |

(Continued)

OTHER PUBLICATIONS

U.S. Appl. No. 12/589,050, filed Oct. 16, 2009.

(Continued)

*Primary Examiner* — Harry Grosso

(74) *Attorney, Agent, or Firm* — Baker Botts L.L.P.

(57) ABSTRACT

A container having a base, a lid, and a tamper-evident, closed band. The base includes a sealing section and defines a space and an opening at a periphery that has an outwardly extending base flange with a contact surface. The lid has a lid sealing section and an outwardly extending lid flange having a contact surface. The base sealing section and the lid sealing section form a reclosable snap fit. The lid and base flanges can also include a removed portion to create an increased distance between contact surfaces on the lid and base flanges. The tamper-evident, closed band can attach at a first end to one of the base and lid, with a free second end, can be substantially detachable from the base or lid as a closed band, and can also extend to substantially prevent direct manual access to the lid and base flanges.

56 Claims, 16 Drawing Sheets

U.S. PATENT DOCUMENTS 4,262,814 A 4/1981 Roccaforte
4,332,332 A 6/1982 Ingemann
4,433,793 A 2/1984 Ingemann
4,453,666 A 6/1984 Gordon
4,520,943 A 6/1985 Nielsen
4,535,889 A 8/1985 Terauds
4,541,541 A 9/1985 Hickman et al.
4,560,082 A 12/1985 Sutch
4,610,371 A 9/1986 Karkiewicz
4,671,453 A 6/1987 Cassidy
4,678,083 A 7/1987 Anderson
4,721,210 A 1/1988 Lawrence et al.
4,742,935 A 5/1988 Schellenberg
4,747,510 A 5/1988 Mack
4,757,898 A 7/1988 Klein
4,759,463 A 7/1988 Mazoin
4,765,463 A 8/1988 Chanel
4,785,963 A 11/1988 Magley
4,792,054 A 12/1988 Weidman
4,819,824 A 4/1989 Longbottom et al.
4,854,472 A 8/1989 Semersky
4,874,096 A 10/1989 Tessera-Chiesa
4,878,595 A 11/1989 Uhlig
4,881,656 A 11/1989 Chumley et al.
4,890,758 A 1/1990 Gailus
4,930,656 A 6/1990 Van Erden et al.
4,966,292 A 10/1990 Marino et al.
4,966,294 A 10/1990 Mack et al.
4,974,735 A 12/1990 Newell et al.
4,998,622 A 3/1991 Drack
5,002,198 A 3/1991 Smith
5,007,231 A 4/1991 Ingemann
5,027,969 A 7/1991 Lesquir
5,040,695 A 8/1991 Adams et al.
5,052,572 A 10/1991 Pherigo
5,052,574 A 10/1991 McKinnon et al.
5,111,953 A 5/1992 Faust et al.
5,111,954 A 5/1992 Gaudreault
5,114,068 A 5/1992 Reil et al.
5,115,934 A 5/1992 Nelson
5,129,531 A 7/1992 Beck et al.
5,163,575 A 11/1992 Luch et al.
5,170,905 A 12/1992 Luch
5,219,074 A 6/1993 Mizuno et al.
5,219,087 A 6/1993 Christensson
5,249,694 A 10/1993 Nelson
5,283,940 A 2/1994 Luch et al.
5,287,959 A 2/1994 Hansen et al.
5,307,948 A 5/1994 Blackburn et al.
5,377,860 A 1/1995 Littlejohn et al.
5,405,629 A 4/1995 Marnocha et al.
5,421,473 A 6/1995 McCrossen
5,437,386 A 8/1995 Von Holdt
5,507,405 A 4/1996 Thomas et al.
5,507,406 A 4/1996 Urciuoli et al.
5,511,679 A 4/1996 Beck
5,511,680 A 4/1996 Kinne
5,528,814 A 6/1996 Luch et al.
5,545,375 A 8/1996 Tropsha et al.
5,573,134 A 11/1996 Chenault et al.
5,582,853 A 12/1996 Marnocha et al.
5,603,422 A 2/1997 Herrmann
5,607,075 A 3/1997 Burgdorf et al.
5,626,251 A 5/1997 Luburic et al.
5,683,771 A 11/1997 Tropsha
5,842,593 A 12/1998 von Holdt
5,875,913 A 3/1999 Letica
5,897,011 A 4/1999 Brilliant et al.
5,931,291 A 8/1999 Sedon et al.
5,931,332 A 8/1999 Mygatt et al.
5,979,690 A 11/1999 Hartley
6,000,570 A 12/1999 Nelson
6,056,141 A 5/2000 Navarini et al.
RE36,729 E 6/2000 Luch et al.
6,116,501 A 9/2000 Hupp
6,135,304 A 10/2000 Wyslotsky
6,168,044 B1 1/2001 Zettle et al.
6,193,921 B1 2/2001 Nelson
6,257,435 B1 7/2001 Chedister et al.
6,273,291 B1 * 8/2001 Conti ..... 220/781
6,276,529 B1 8/2001 Feehan, Jr.
6,279,774 B1 8/2001 Clute et al.
6,299,012 B1 10/2001 Redmond
6,328,355 B1 12/2001 Bortz
6,349,828 B1 2/2002 Sessions et al.
6,564,958 B1 5/2003 Ramsey et al.
6,572,909 B1 6/2003 Bagwell et al.
6,604,645 B1 8/2003 Vaupotic
6,712,233 B2 3/2004 Arshinoff
6,899,245 B1 5/2005 Nelson
7,011,221 B2 3/2006 Smith et al.
7,011,228 B2 3/2006 Ordiway
7,021,826 B2 4/2006 Benjamins
7,073,680 B2 7/2006 Boback et al.
7,097,058 B2 8/2006 Wellman et al.
7,114,619 B2 10/2006 Ellis et al.
7,118,003 B2 10/2006 Sellari et al.
7,191,931 B2 3/2007 Damkjaer
7,222,741 B2 5/2007 Chmela et al.
7,235,207 B2 6/2007 Gregory et al.
7,243,813 B2 7/2007 Krueger
7,246,714 B2 7/2007 Garg et al.
7,281,638 B2 10/2007 Hierzer et al.
7,303,088 B2 12/2007 Sawyer et al.
7,311,218 B2 12/2007 Varadarajan
7,338,209 B2 3/2008 Winpenny
7,357,272 B2 4/2008 Maxwell
7,374,053 B2 5/2008 Herald et al.
7,475,780 B2 1/2009 Hinze et al.
7,475,788 B2 1/2009 Schwarz
7,549,540 B2 6/2009 Lee et al.
7,611,025 B2 11/2009 Nusbaum et al.
7,631,776 B2 12/2009 Vovan
7,694,837 B2 4/2010 Robertson et al.
7,757,848 B2 7/2010 Gelardi et al.
2002/0144998 A1 10/2002 Lees et al.
2002/0170914 A1 11/2002 Witt
2003/0052133 A1 3/2003 Hayes et al.
2003/0127419 A1 7/2003 Shenkar et al.
2003/0160051 A1 8/2003 Ciccone
2003/0183636 A1 10/2003 Shih
2003/0189048 A1 10/2003 Luburic
2004/0045867 A1 3/2004 Appelbaum
2004/0118848 A1 6/2004 Marshall
2004/0134910 A1 7/2004 Colombo
2004/0200839 A1 10/2004 Conti
2005/0145628 A1 7/2005 Schwarz
2005/0252916 A1 11/2005 Varadarajan
2006/0003879 A1 1/2006 Buchman
2006/0006178 A1 1/2006 Foldesi et al.
2006/0011632 A1 1/2006 Caille
2006/0060578 A1 3/2006 Church et al.
2006/0144874 A1 7/2006 Solowiejko
2006/0163265 A1 7/2006 De Candido
2006/0175334 A1 8/2006 Schwarz
2006/0201946 A1 9/2006 Witt
2006/0255054 A1 11/2006 Vovan
2006/0261070 A1 11/2006 Robertson et al.
2006/0266750 A1 11/2006 Lesquir
2006/0278652 A1 12/2006 Vovan et al.
2006/0289549 A1 12/2006 Vovan
2007/0012710 A1 1/2007 Vovan
2007/0045317 A1 3/2007 Rosender et al.
2007/0062903 A1 3/2007 Norman et al.
2007/0062948 A1 3/2007 Albrecht et al.
2007/0095848 A1 5/2007 Galland et al.
2007/0108210 A1 5/2007 Alvares et al.
2007/0138046 A1 6/2007 Vovan
2007/0138180 A1 6/2007 Vovan
2007/0164026 A1 7/2007 Morrissey et al.
2007/0196541 A1 8/2007 Vovan et al.
2008/0000904 A1 1/2008 Vovan
2008/0006632 A1 1/2008 Vovan
2008/0110887 A1 5/2008 Ramsey et al.
2008/0185383 A1 8/2008 Philippe et al.
2008/0199108 A1 8/2008 Rogers
2009/0021026 A1 1/2009 Collier

| | | | | |
|---|---|---|---|---|
| 2009/0032534 | A1* | 2/2009 | Luburic | 220/266 |
| 2009/0032545 | A1 | 2/2009 | Zeiler et al. | |
| 2009/0057313 | A1 | 3/2009 | Alvares | |
| 2009/0120936 | A1 | 5/2009 | Zauser et al. | |
| 2009/0120942 | A1 | 5/2009 | Vovan | |
| 2009/0206082 | A1 | 8/2009 | Vovan | |
| 2010/0072205 | A1 | 3/2010 | Stuart | |
| 2010/0072217 | A1 | 3/2010 | Parikh et al. | |
| 2010/0155289 | A1 | 6/2010 | Nazareth et al. | |

FOREIGN PATENT DOCUMENTS

| | | |
|---|---|---|
| DE | 4418935 | 12/1995 |
| DE | 29819718 | 1/1999 |
| DE | 29914659 U1 | 8/1999 |
| EP | 0752374 | 1/1997 |
| EP | 1559656 | 8/2005 |
| FR | 2819496 | 7/2002 |
| GB | 2257118 | 1/1993 |
| WO | WO 2005/082733 | 9/2005 |
| WO | WO2005082734 | 9/2005 |

OTHER PUBLICATIONS

U.S. Appl. No. 12/589,050, Non-Final Rejection dated Dec. 9, 2010.
U.S. Appl. No. 12/589,050, Amendment dated Mar. 9, 2011.
U.S. Appl. No. 11/230,978, Non-Final Rejection dated Apr. 15, 2011.
U.S. Appl. No. 11/230,978, Non-Final Rejection dated Sep. 16, 2010.
U.S. Appl. No. 11/230,978, Response to Non-Final Rejection dated Dec. 28, 2010.
U.S. Appl. No. 11/446,622, filed Jun. 5, 2006.
U.S. Appl. No. 11/230,978, filed Sep. 20, 2005.
U.S. Appl. No. 11/446,622, Non-Final Rejection dated Jan. 26, 2009.
U.S. Appl. No. 11/446,622, Amendment dated Mar. 26, 2009.
U.S. Appl. No. 11/446,622, Supplemental Response dated Jun. 5, 2009.
U.S. Appl. No. 11/446,622, Final Rejection dated Jun. 24, 2009.
U.S. Appl. No. 11/446,622, Amendment After Final dated Sep. 15, 2009.
U.S. Appl. No. 11/446,622, Amendment After Final dated Oct. 19, 2009.
U.S. Appl. No. 11/446,622, Notice of Allowance dated Oct. 19, 2009.
U.S. Appl. No. 11/230,978, Non-Final Rejection dated Jun. 2, 2008.
U.S. Appl. No. 11/230,978, Amendment dated Sep. 15, 2008.
U.S. Appl. No. 11/230,978, Supplemental Response dated Jan. 26, 2009.
U.S. Appl. No. 11/230,978, Final Rejection dated May 14, 2009.
U.S. Appl. No. 11/230,978, Amendment and Request for Continued Examination dated Aug. 13, 2009.
U.S. Appl. No. 11/230,978, Non-Final Rejection dated Sep. 10, 2009.
U.S. Appl. No. 11/230,978, Amendment dated Feb. 9, 2010.
U.S. Appl. No. 11/230,978, Final Rejection dated May 27, 2010.
U.S. Appl. No. 11/230,978, Amendment and Request for Continued Examination dated Aug. 27, 2010.
Food Container purportedly published in Apr. 2005.
Safer Sandwiches, www.packagingtoday.co.uk—Packaging Today, purportedly published in Apr. 2005.
Tamper Evident Container, dated Sep. 13, 2004, and purportedly exhibited in a foreign country in Apr. 2005.
Tri-Star to Unveil First Even Tamper Evident Salad Containers at Total Sandwich Show, Sandwich and Snack News, purportedly published in Apr. 2005.
U.S. Appl. No. 13/301,214, Mar. 15, 2012 Non-Final Office Action.
U.S. Appl. No. 13/301,214, Nov. 21, 2011.

* cited by examiner

TAMPER-EVIDENT CONTAINER WITH EXTENDED BAND

CROSS-REFERENCE TO RELATED APPLICATIONS

This application is a continuation-in-part of U.S. patent application Ser. No. 11/446,622, filed 5 Jun. 2006, now U.S. Pat. No. 7,631,776 which clams priority to U.S. Provisional Application No. 60/689,394, filed 10 Jun. 2005. This application is also a continuation-in-part of U.S. patent application Ser. No. 11/230,978, filed 20 Sep. 2005, now U.S. Pat. No. 8,083,089 which clams priority to U.S. Provisional Application No. 60/698,736, filed 13 Jul. 2005. Each of these applications are incorporated by reference herein in their entireties.

BACKGROUND OF THE INVENTION

1. Field of the Invention

The inventions relate generally to containers, particularly tamper-evident containers with extended bands.

2. Description of the Related Art

Retail markets have utilized rigid and flexible plastic containers to contain and display perishable and fragile food items both hot and cold, such as sandwiches, salads and bakery items. These traditional roles of plastic packaging are now the minimum expected standards, and the requirements placed on plastic food packaging continue to expand as increasing demands are placed upon it. Presentation, brand presence, consumer desires, added value to enhance commercial competitiveness, differentiation, imagery and psychology has resulted in the design and application of plastic packaging becoming more challenging. Convenience continues to shape the future of packaging, with consumers gravitating toward packaged convenience items that minimize the impact on their behavior forcing packaging manufacturers to include social and environmental considerations into their development process.

Rigid plastic food containers are typically manufactured from Polystyrene, Polypropylene, Polyethylene Terephthalate (PET), Polylactide, Polyvinyl Chloride (PVC), or other rigid polymers. They generally comprise either of two-parts—a tray and base—or they may be a one-piece construction with a hinge that modifies one portion of the container to act as the base and the other connected portion to act as a lid. This general configuration of food containers in a large variety of shapes and cross-sections (circular, rectangular, square, and elliptical, etc.) has been available in the marketplace for many years.

However, a limitation or concern has been undisclosed potentially malicious ingress into such containers that can lead to inadvertent or intentional contamination of the contents of the food container. This has created an increased awareness of and demand for tamper-resistant and tamper-evident food packaging systems. Product tampering has been in existence for as long as there have been packaged consumer goods. The causes of tampering are varied but generally take one of two forms: the first is malevolent tampering, and the second is for personal gratification, where one samples a product and puts it back on the shelf and the next customer is unaware of the contamination. Both modes of tampering compromises the safety and quality of food package contents. The costs of tampering are enormous. In addition to the recalling of tampered, as well as un-tampered product, the resulting negative publicity can lead to reduction in revenue and brand equity, with retailers being forced to stop purchasing from one or more products form the affected company or even litigation.

In 1982, Johnson and Johnson (J&J) experienced such a situation when numerous bottles of its Extra-Strength Tylenol capsules had been laced with cyanide. By the end of the crisis, J&J had spent $100 million recalling 31 million bottles, they ceased production of the product and further pursued redesign of its bottles. Seven people died from the ingestion of the cyanide-laced pills. The threat of tampering has been amplified in the wake of the terrorist attack of Sep. 11, 2001. Possible contamination of food product on a potentially larger scale been envisioned.

In the packaging industry, tampering is the interference with the package contents, and the risk of tampering is a phenomenon that we have come to accept as a necessary evil when making purchases. Today, it is impossible to find food packaging that does not have a security feature. Virtually every packaged food product is enclosed or is attached to a tamper-evident or tamper-proof security feature. Tamper-evident means that a package that has undergone tampering will show some readily observable sign that the tampering has taken place; the sign may be audible or visible. It is the opinion of the inventor that in addition to its functions of protecting the product inside against physical and microbiological harm and oxygen ingress, and of providing brand recognition and product differentiation in the marketplace, packaging should also be designed to protect the consumer against tampering, whether deliberate or accidental.

Methods developed and currently used to combat tampering have included bonding the edges of existing packages. The advantage of such an approach is that a barrier against tampering could be achieved without changing the packaging design. Alternatively, addition of clear or printed shrink-wrap over the neck edge joint between the lid and tray or the entire package that keeps the packaging and its contents secure have been used. These methods provide some assurance to the consumer that the product has not been interfered with. Similarly, other attempts developed to combat packaging product tampering include under-lid barriers (e.g. heat-sealed pop-up lids, glued boxes and tape seals).

A limitation associated with these methods, however, is that they achieve only a low level of tamper-evident packaging. They are either not sufficiently or distinctively visible to the consumer, or they can be returned to their original condition with a glue gun and a hair dryer. This further makes disposal of unused sealing material a security issue as unused, intact seals may be used to reseal contaminated product.

It would be advantageous to consumers if there were a simple method that would rapidly indicate if a rigid plastic food package had been interfered with, that is, opened and then re-closed prior to purchase.

As it is extremely difficult to develop product packaging that is regarded as fully tamper-proof, the packaging industry's efforts have been directed to develop solutions that would ensure that any tampering can be clearly visible to the potential consumer. In response to the evolving demands of consumers, retailers continue to seek novel plastic packaging solutions to improve on the safety, convenience and therefore marketability of food product.

As such, the inventors recognizes that greater utility of such rigid plastic containers would be obtained through improved tamper-evident containerization methods and designs to increase the safety to the consumer but yet retains both the functional aspects required from rigid plastic packaging. The present inventions fulfill this need.

SUMMARY OF THE INVENTIONS

In one embodiment, a container can include a base, a lid, and a tamper-evident, closed band. The base can define a space and an opening at a periphery, the opening can include at least one outwardly extending base flange, and the flange can have a contact surface. The base can also include a base sealing section. The lid can have a shape that generally matches the opening of the base generally at a periphery of the lid. The lid can also include at least one outwardly extending lid flange with a contact surface at the periphery, as well as a lid sealing section. The base sealing section and the lid sealing section can together form a reclosable snap fit when the lid is forcibly applied to the opening of the base to generally close the opening. Further, the base flange and lid flange can be in at least approximate alignment when the opening is closed such that the lid and base flanges can be manually pulled apart to separate the lid and base and overcome the snap fit. The lid and base flanges can also include a removed portion to create an increased distance between contact surfaces on the lid and base flanges at least one region. The tamper-evident, closed band can attach at a first end to one of the base and lid substantially along its entire periphery. At a second end, the band can have a free end. The tamper-evident band can be substantially detachable from the base or lid as a closed band. The band can also extend to substantially prevent direct manual access to the lid and base flanges.

In another embodiment, a container can also include a base, a lid, and a tamper-evident tab. The base can define a space and an opening at a periphery, the opening having at least one outwardly extending base flange, and the base flange having a contact surface. The base can also have a sealing section. The lid can define a shape that generally matches the opening of the base generally at a periphery of the lid. The lid can also have at least one outwardly extending lid flange that has a contact surface at the periphery such that the base flange and lid flange can be in at least approximate alignment when the opening is closed by the lid. Further, the lid can have a sealing section such that the lid sealing section and the base sealing section can together form a continuous reclosable snap fit connection. This can allow the lid and base flanges to be manually pulled apart to separate the lid and base. The lid and base flanges can additionally have a removed portion creating an increased distance between corresponding contact surfaces of the lid and base flanges at least one region. The tamper-evident, closed band can attach at a first end to one of the base and lid substantially along its entire periphery. The band can also have a free end at a second end. The tamper-evident band can extend to substantially prevent direct manual access to the lid and base flanges. Further, the band can be detachable from the base or lid at a separated portion such that the band can be bent at the separated portion to allow manual access to the lid and base flanges near the separated portion.

In yet another embodiment, a container can include a base, a lid, and a tamper-evident band. The base can define a space and an opening at a periphery. The opening can include at least one outwardly extending base flange. Further, the base can have a base sealing section. The lid can define a shape that generally matches the opening of the base generally at a periphery of the lid. The lid can also include at least one outwardly extending lid flange at the periphery and a lid sealing section, such that the base sealing section and the lid sealing section can together form a continuous and reclosable snap fit when the lid is forcibly applied to the opening of the base to generally close the opening. The base flange and lid flange can also be in at least approximate alignment when the opening is closed such that the lid and base flanges can be manually pulled apart to separate the lid and base and overcome the snap fit. The tamper-evident band can attach at a first end to one of the base and lid substantially along its entire periphery and have a free end at a second end. The tamper-evident band can extend to substantially prevent direct manual access to the lid and base flanges. The band can also be detachable from the base or lid such that a majority of the lid and base flanges can be exposed upon detachment. However, the band can remain partially attached to one of the base and lid and the band can sever into a strip near the remaining partial attachment.

In another embodiment, a base can define a space and an opening at a periphery, the opening comprising at least one outwardly extending base flange and the base further comprising a base snap-fit portion. A lid can define a shape that generally matches the opening of the base generally at a periphery of the lid. The lid also can have at least one outwardly extending lid flange at the periphery and a lid snap-fit portion, such that the base snap-fit portion and the lid snap-fit portion can together form a snap fit when the lid is forcibly applied to the opening of the base to generally close the opening. Also, the base flange and lid flange can be in at least approximate alignment when the opening is closed such that the lid and base flanges can be manually pulled apart to separate the lid and base and overcome the snap fit. A tamper-evident band can attach at a first end to the lid substantially along its entire periphery and have a free end at a second end. The tamper-evident band can be substantially detachable from the lid at least a corner portion. Further, the band can extend to substantially prevent direct manual access to the lid and base flanges. Upon tearing, the band can remain partially attached to the one of the base and lid, forming a strip and a remaining partial attachment.

In a further embodiment, a base can define a space and an opening at a periphery, the opening comprising at least one outwardly extending base flange, the flange having a contact surface, and the base further comprising a base snap-fit portion. A lid can define a shape that generally matches the opening of the base generally at a periphery of the lid. The lid can also have at least one outwardly extending lid flange having a contact surface at the periphery and a lid snap-fit portion, such that the base snap-fit portion and the lid snap-fit portion can together form a continuous reclosable snap fit when the lid is forcibly applied to the opening of the base to generally close the opening. Also, the base flange and lid flange can be in at least approximate alignment when the opening is closed such that the lid and base flanges can be manually pulled apart to separate the lid and base and overcome the snap fit. A tamper-evident band can attach at a first end to at least one of the lid and base. The band can be tearable from the lid or base along at least ⅕ of the first end. The band can additionally have a corner lock along a corner wall portion. The band can prevent direct manual access to the lid and base flanges while attached to at least one of the lid and base. The band can expose the lid and base flanges upon tearing, such that the flanges or band can be pulled to separate the lid and base.

In a further embodiment, a base can define a space and an opening at a periphery, the opening comprising at least one outwardly extending base flange and the base further comprising a base snap-fit portion. A lid can define a shape that generally matches the opening of the base generally at a periphery of the lid. The lid can also have at least one outwardly extending lid flange at the periphery and a lid snap-fit portion, such that the base snap-fit portion and the lid snap-fit portion can together form a continuous reclosable snap fit when the lid is forcibly applied to the opening of the base to generally close the opening. Also, the base flange and lid flange can be in at least approximate alignment when the opening is closed such that the lid and base flanges can be manually pulled apart to separate the lid and base and overcome the snap fit. A tamper-evident band can attach at a first end to the lid substantially along its entire periphery and have a free end at a second end. The tamper-evident band can be substantially detachable from the lid at least a separating portion. The band can also include two or more inward protrusions that abut the base flange at the separating portion at least when the band is pulled upward from the base.

In a further embodiment, a base can define a space and an opening at a periphery, the opening comprising at least one outwardly extending base flange and the base further comprising a base snap-fit portion. The base and the opening can also define a polygonal shape with one or more corners. A lid can define a shape that generally matches the opening of the base generally at a periphery of the lid. The lid can also have at least one outwardly extending lid flange at the periphery and a lid snap-fit portion, such that the base snap-fit portion and the lid snap-fit portion can together form a continuous horizontal snap fit when the lid is forcibly applied to the opening of the base to generally close the opening. Also, the base flange and lid flange can be in at least approximate alignment when the opening is closed such that the lid and base flanges can be manually pulled apart to separate the lid and base and overcome the snap fit. A tamper-evident band can attach at a first end to the lid along each of its sides and be unattached at least one corner portion. The tamper-evident band can also have a free end at a second end. The tamper-evident band can substantially detachable from the lid. Prior to detachment, the band extends to substantially prevent direct manual access to the lid and base flanges. The band can also include two or more inward protrusions (68) that abut the base flange at the corner portion at least when the band is pulled upward from the base.

In an additional embodiment, a container lid can be configured to form a snap-fit with a base. The container lid can have a broad central portion, a snap-fit portion, a lid flange, and a detachable skirt. The snap-fit portion can be at a periphery of the broad central portion and be configured to form a snap-fit with a base. Outward from the snap-fit portion can be the lid flange with one or more raised portions at a corner of the lid flange. Finally, the skirt can be detachable and attached to the lid flange along the periphery of the container lid. The skirt can also have one or more inward protrusions.

In another embodiment, a method of forming a container can be provided. A first portion can be formed, defining a space, an opening, a periphery, and a sealing portion. A second portion can be formed and shaped to cover the opening. The second portion can also include a periphery and a sealing portion. A series of perforations can then be cut in at least one of the first or second portions to form a removeable, closed band encircling a periphery of the first or second portion. The first portion can be applied to the second portion, bringing the two sealing portions adjacent each other and closing the opening. Advantageously, the closed band can extend to block access to the periphery of a first or second portion to which it is not attached.

BRIEF DESCRIPTION OF THE DRAWINGS

The following drawings and the associated descriptions are provided to illustrate particular embodiments of the present disclosure and do not limit the scope of the claims.

DETAILED DESCRIPTION OF THE PREFERRED EMBODIMENTS

The following description and examples illustrate preferred embodiments of a container system. The container system is disclosed in the context of use with various food products. The principles of the present invention, however, are not limited to food products. It will be understood by those of skill in the art in view of the present disclosure that the container system described can be used with other types of goods, including, but not limited to: haberdashery, fasteners, pharmaceuticals, chemicals, and the like. One skilled in the art may also find additional applications for the devices and systems disclosed herein. Thus, the illustrations and descriptions of the container system in connection with food are merely exemplary of some possible applications of the container system.

Figure 1:
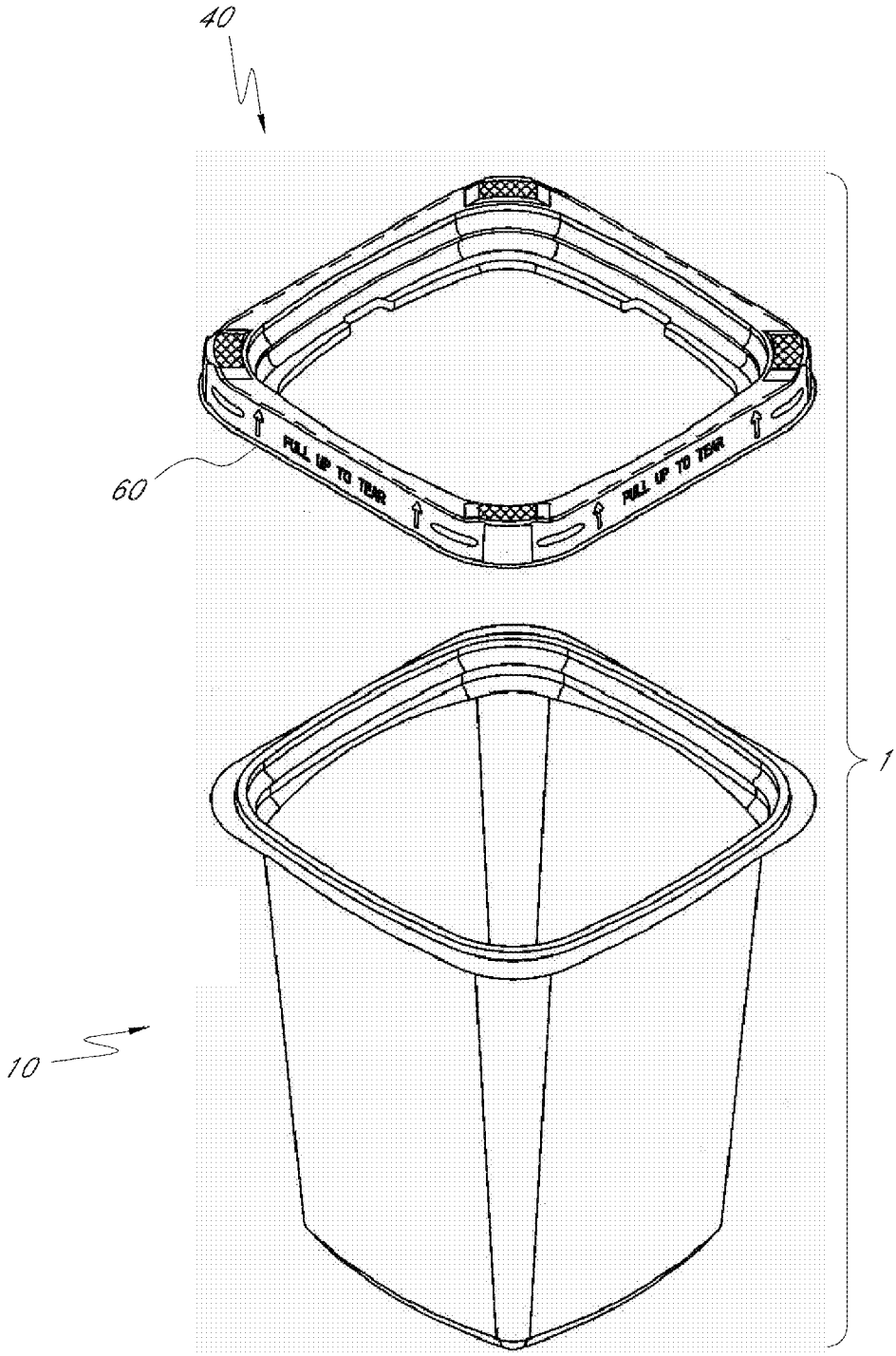
FIG. 1 is a perspective view of an embodiment of a container system in an open position.

To assist in the description of these components, the following coordinate terms are used. FIG. 1 depicts an x-y-z Cartesian coordinate system, with the container system primarily lying in the x-y plane. As described herein, terms such as "height" refer to distance in the z-direction, and "higher/upward" and "lower/downward" refer to the positive and negative z-direction, respectively. Similarly, terms such as "outward" and "inward" generally refer to directions in the x-y plane directed generally away from or toward the center of the container system. Similarly, terms such as "lateral" will refer to the x-direction and "longitudinal" will refer to the y-direction. A detailed description of a preferred embodiment of the container system, and its associated method of use, now follows.

FIG. 1 depicts a container system 1 including a base 10 and a lid 40. As will be further discussed below, the lid 40 can include a band 60, as depicted here. The base 10 can define a space into which foods (or other products) can be inserted. The lid 40 can then be applied to the base 10 to close the space. As will be discussed further below, in the depicted embodiment the space can be sealed from the ambient atmosphere such that the space is leak proof. However, in other embodiments the lid 40 and base 10 can combine to form a fully or partially vented space such that gases, liquids, or larger particles can enter and/or exit.

In a preferred embodiment, the entire container system 1 can be composed of substantially the same material, such as Polystyrene, Polypropylene, Polyethylene Terephthalate (PET), Polylactide, Polyvinyl Chloride (PVC), other thermoplastics, or other materials. However, other materials can be used. Additionally, in preferred embodiments the materials can be clear such that an observer can see the contents of the container system 1 and receive some verification of the freshness, quality, and nature of the goods contained. However, in other embodiments the materials can be frosted, darkened, pigmented, have labels applied, or be treated in other ways.

Additionally, as depicted the container system 1 has a generally square, tubular shape. The base 10 can gradually taper from a smaller bottom 11 to a larger opening at its opposite end. However, other shapes are possible. For example, the container system 1 can have a circular, triangular, hexagonal, ovoid, or other cross-sectional shape. Further, the container system 1 can have a varying cross-sectional shape and size that may differ from that in the depicted embodiment. As one relatively small example regarding shape, in some embodiments the base 10 can include ribbing along its sides.

Figure 2:
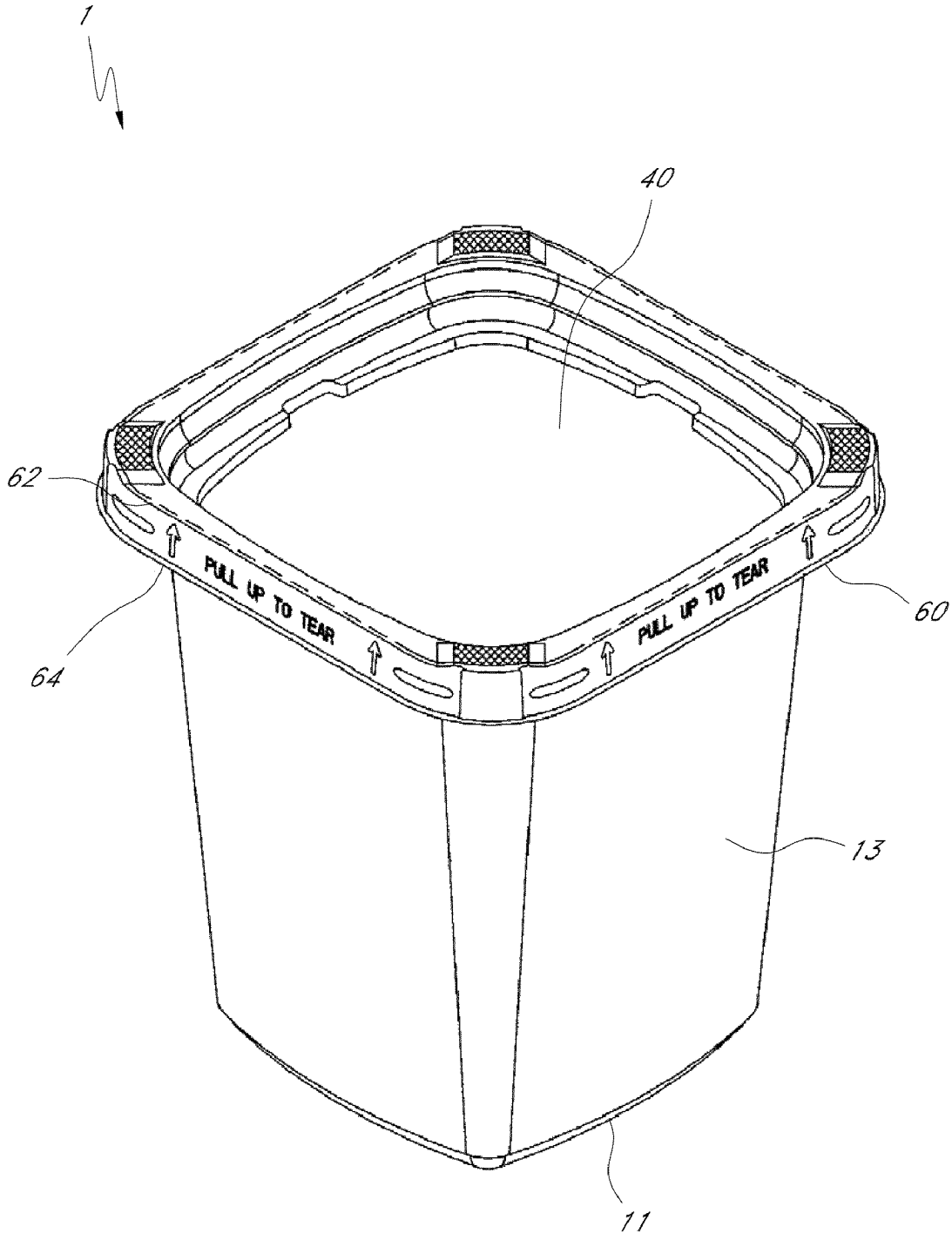
FIG. 2 is a perspective view of the container system of FIG. 1 in a closed position.
Figure 3:
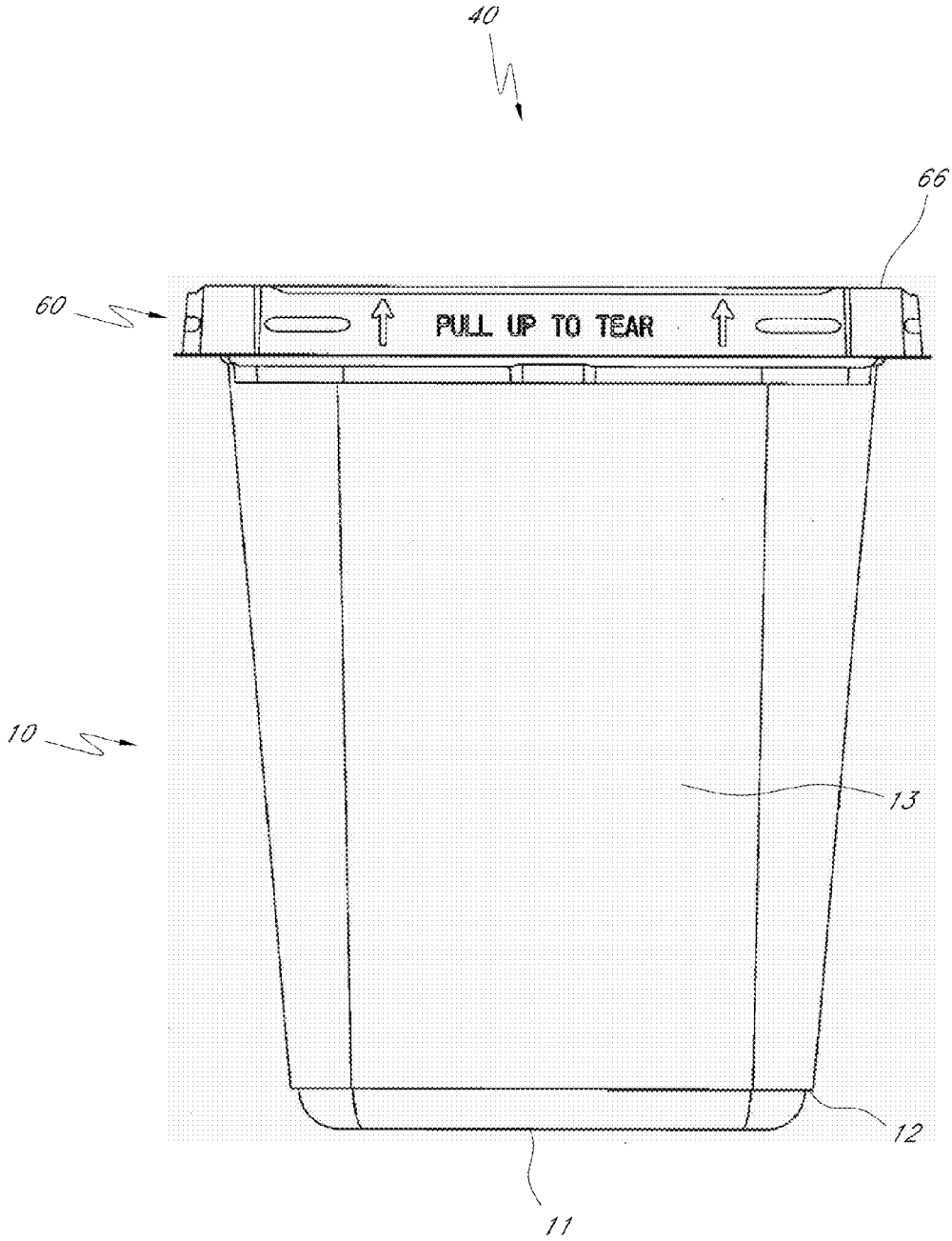
FIG. 3 is a side view of the container system of FIG. 2.

As depicted in FIGS. 2 and 3, the base 10 can include a bottom 11 and four side walls 13. As discussed above, when the container system 1 has a different shape, the number of side walls 13 can vary. Further, as depicted the base 10 can taper downwards, although this is not necessary in all embodiments. Further, as depicted, the base 10 can include a stacking rim 12. The stacking rim 12 can generally match a stacking rim 42 on the lid 40. Thus, when two container systems 1 are stacked, one-on-another, the stacking rims 12, 42 can interengage and significantly improve the stability of the stacked system. Further, the base 10 can include an opening, a flange 14 generally along its periphery, and corner flanges 16 generally at the corners. Even further, although not depicted here, the base 10 can include a variety of additional features such as ribbing, indicia, gripping surfaces, and the like. Also, as will be described in greater detail below, the base 10 can include various features that facilitate opening, closing, and sealing the container system 1.

Figure 4:
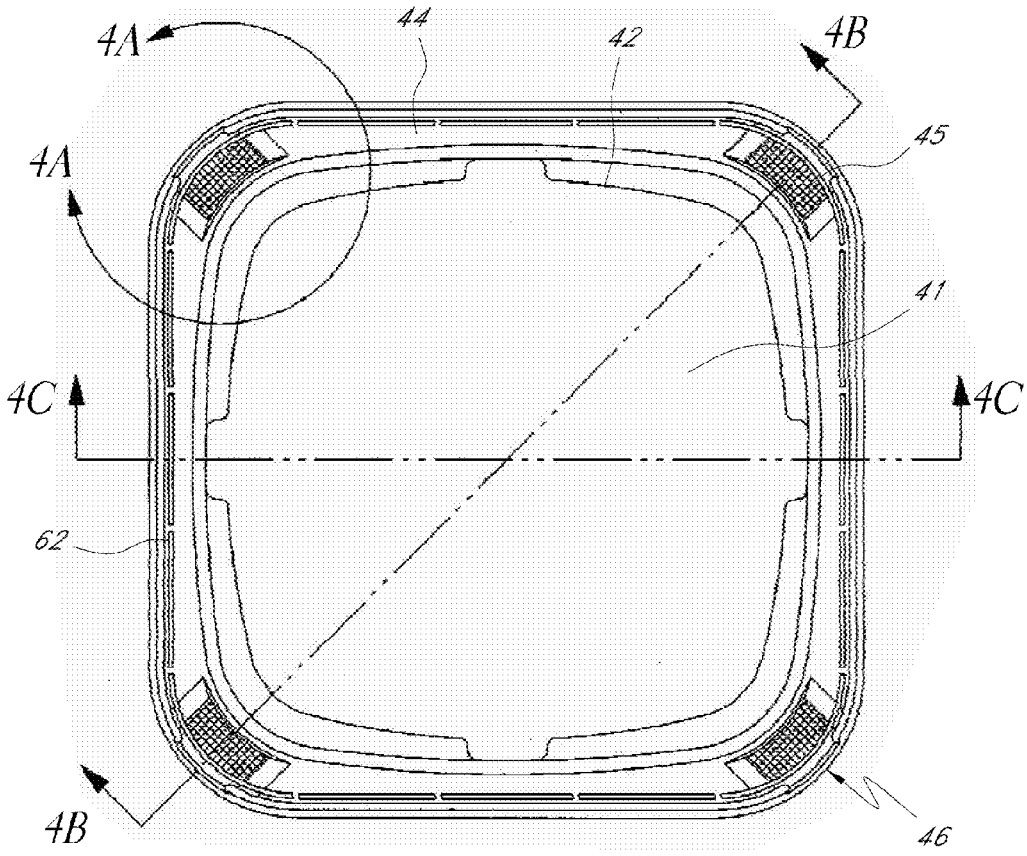
FIG. 4 is a top view of the container system of FIG. 2.
Figure 4A:
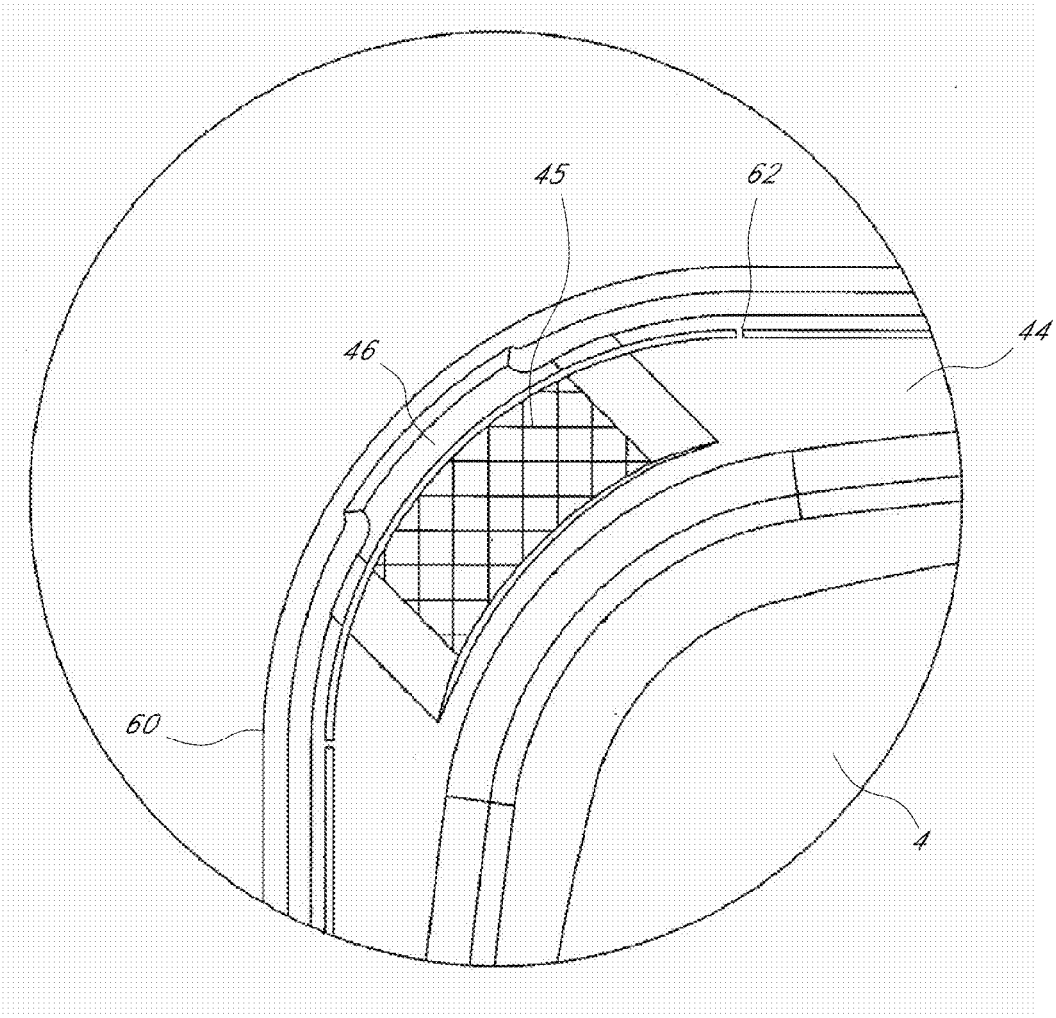
FIG. 4A is an enlarged view of the container system of FIG. 4 at 4A-4A.
Figure 4B:
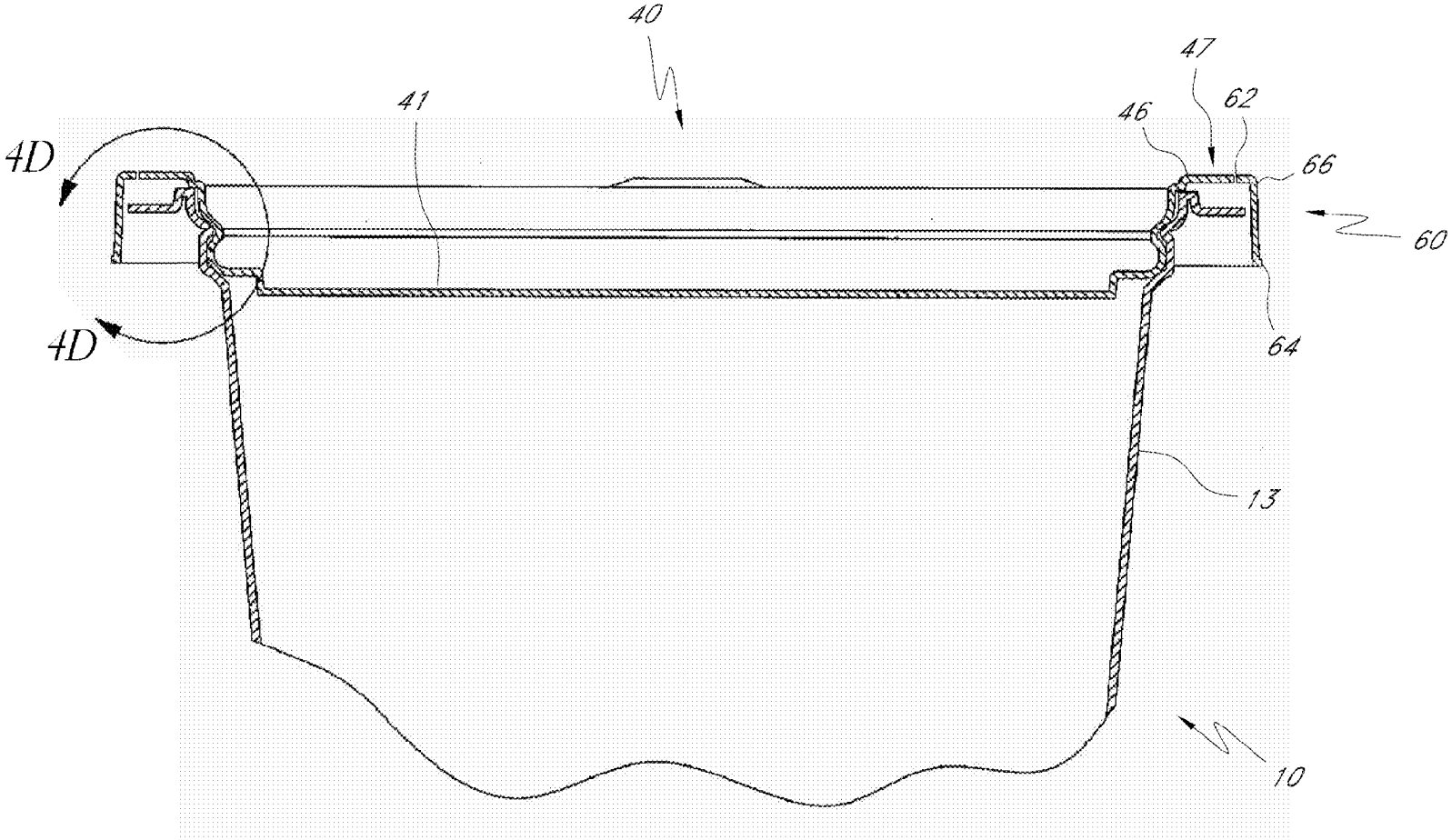
FIG. 4B is a cross-sectional side view of the container system of FIG. 4 at 4B-4B.
Figure 4C:
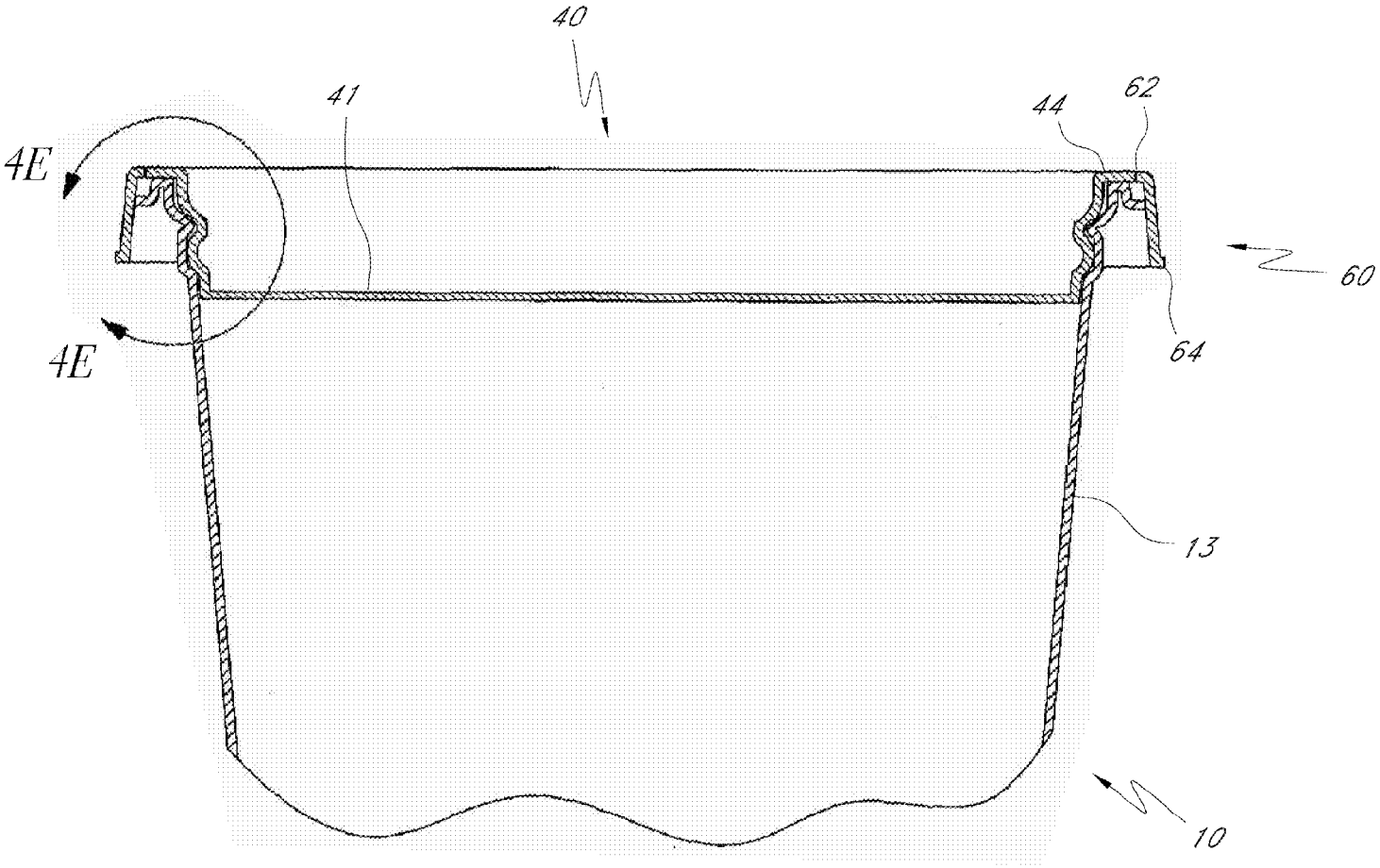
FIG. 4C is a cross-sectional side view of the container system of FIG. 4 at 4C-4C.
Figure 5:
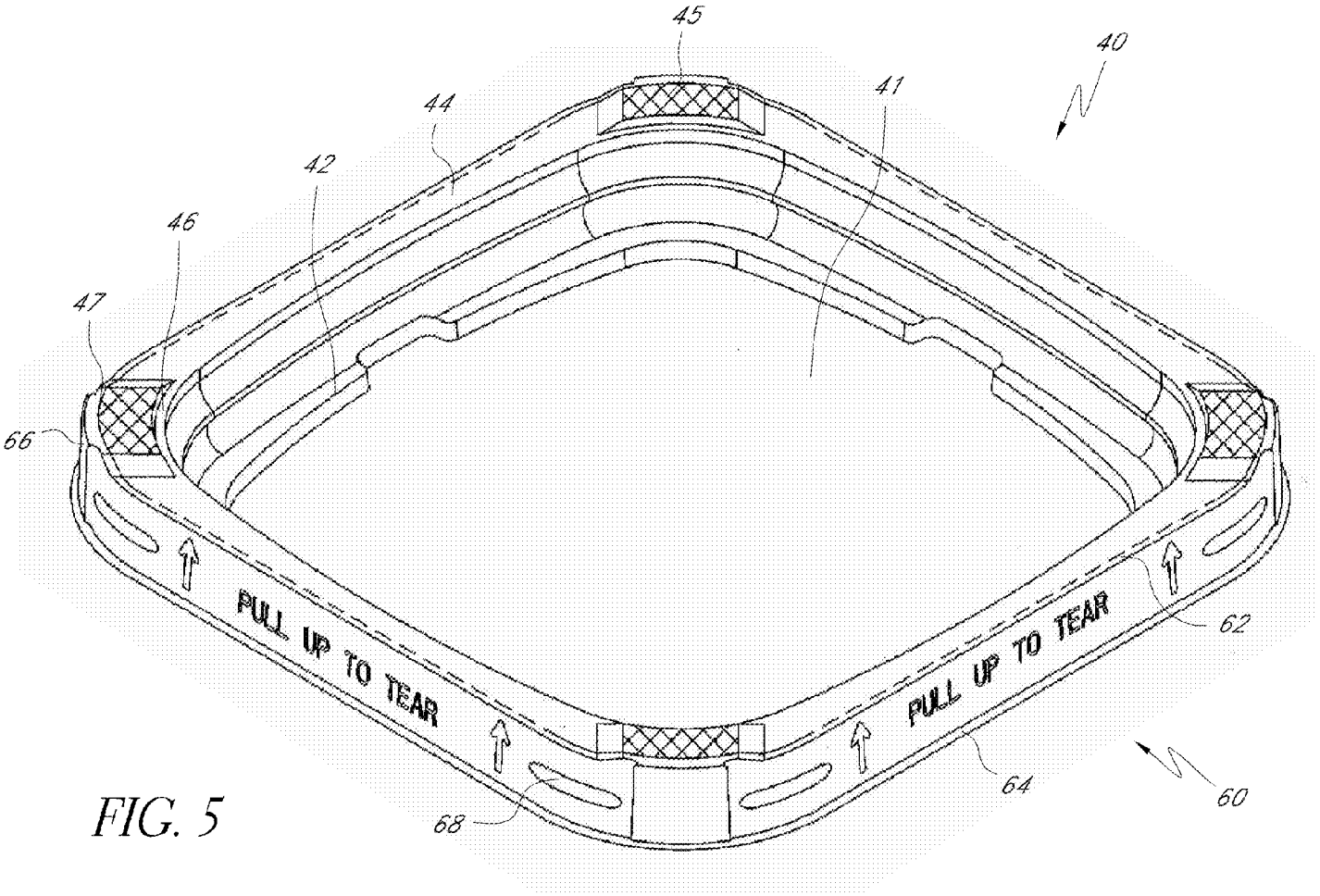
FIG. 5 is a perspective view of the lid of FIG. 1.
Figure 6:
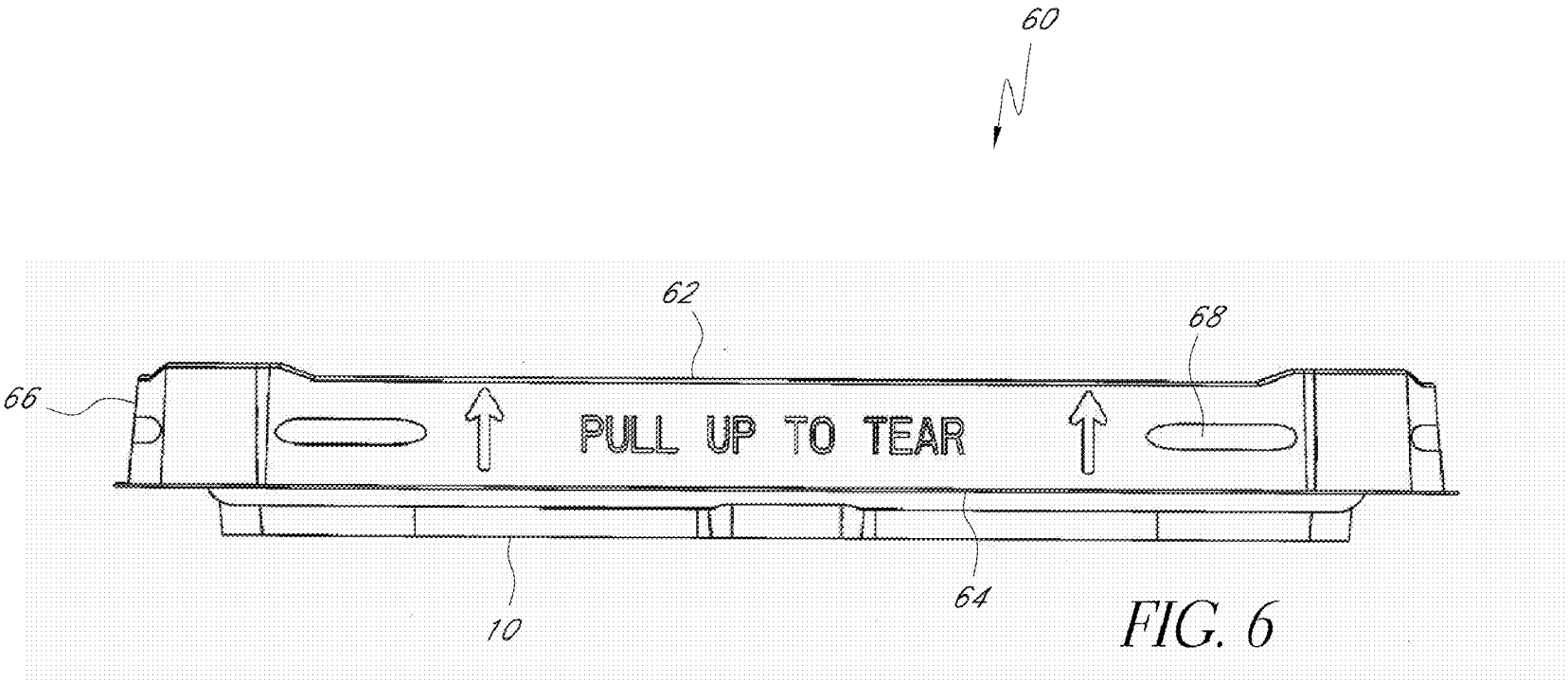
FIG. 6 is a side view of the lid of FIG. 5.
Figure 7:
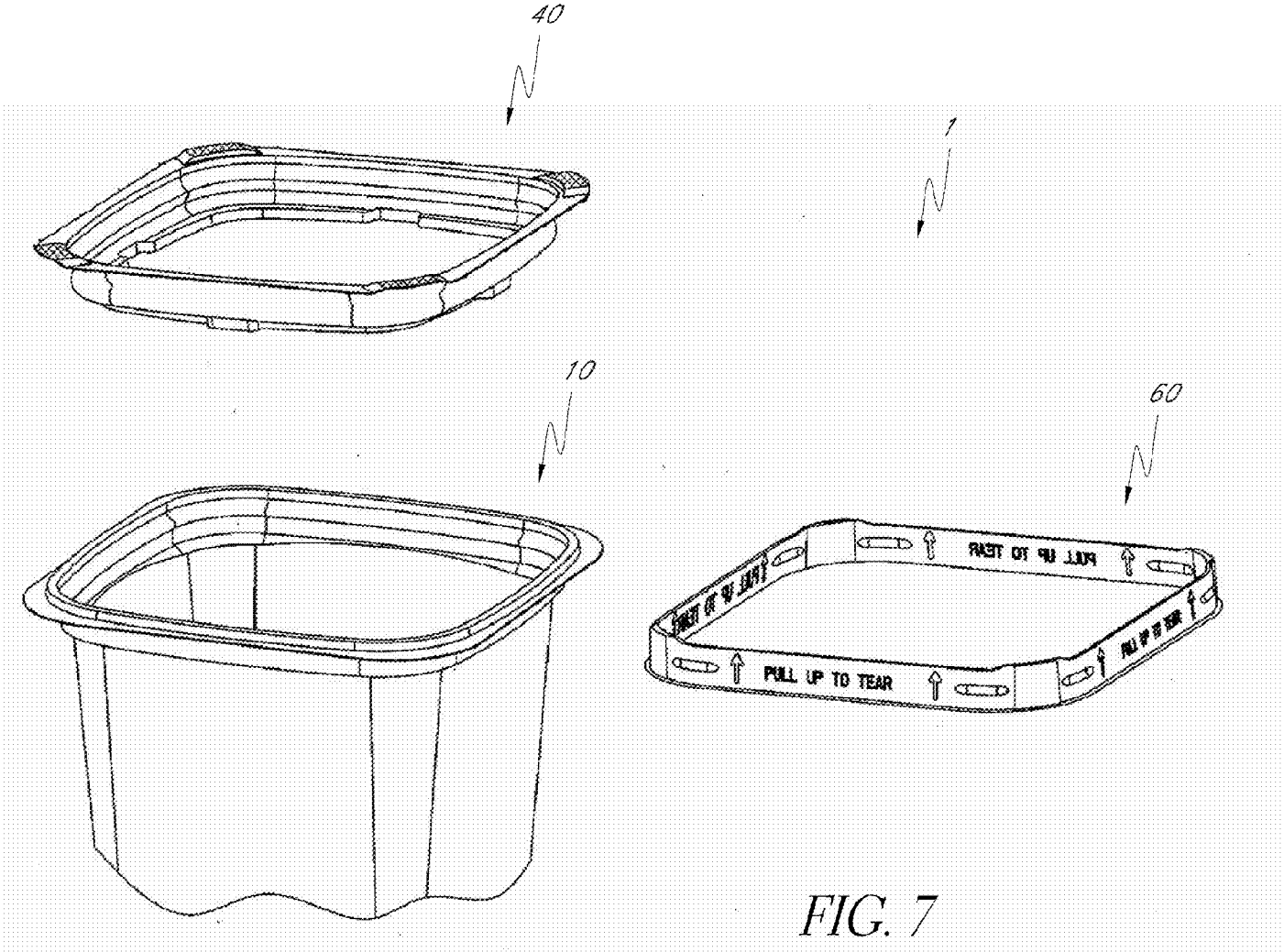
FIG. 7 is a perspective view of the container system of FIG. 1 in an open, torn position.

As depicted in FIGS. 4 and 4A, the lid 40 can have a shape generally similar to that of the base 10. More particularly, the lid 40 in the depicted embodiment can have a shape that approximately matches that of the opening of the base 10. The lid 40 can include a broad portion 41 generally forming the middle of the lid 40. Nearer the periphery, the lid 40 can include a stacking rim 42, as described above, to engage with the stacking rim 12 of the base 10. Even further toward the periphery, the lid 40 can include a flange 44 that can extend to a free end of the lid 40. At the corners of the flange 44 the lid 40 can include a corner flange 46. A gripping surface 45 can be included at the corner flange 46, including an easy-grip surface such as a textured surface. Additionally, as partially depicted in FIGS. 4D, 5, and 6, the corner flange 46 can include a raised portion 47. The corner flange 46 can include a gradually rising ramp on either side of the raised portion 47.

Figure 4D:
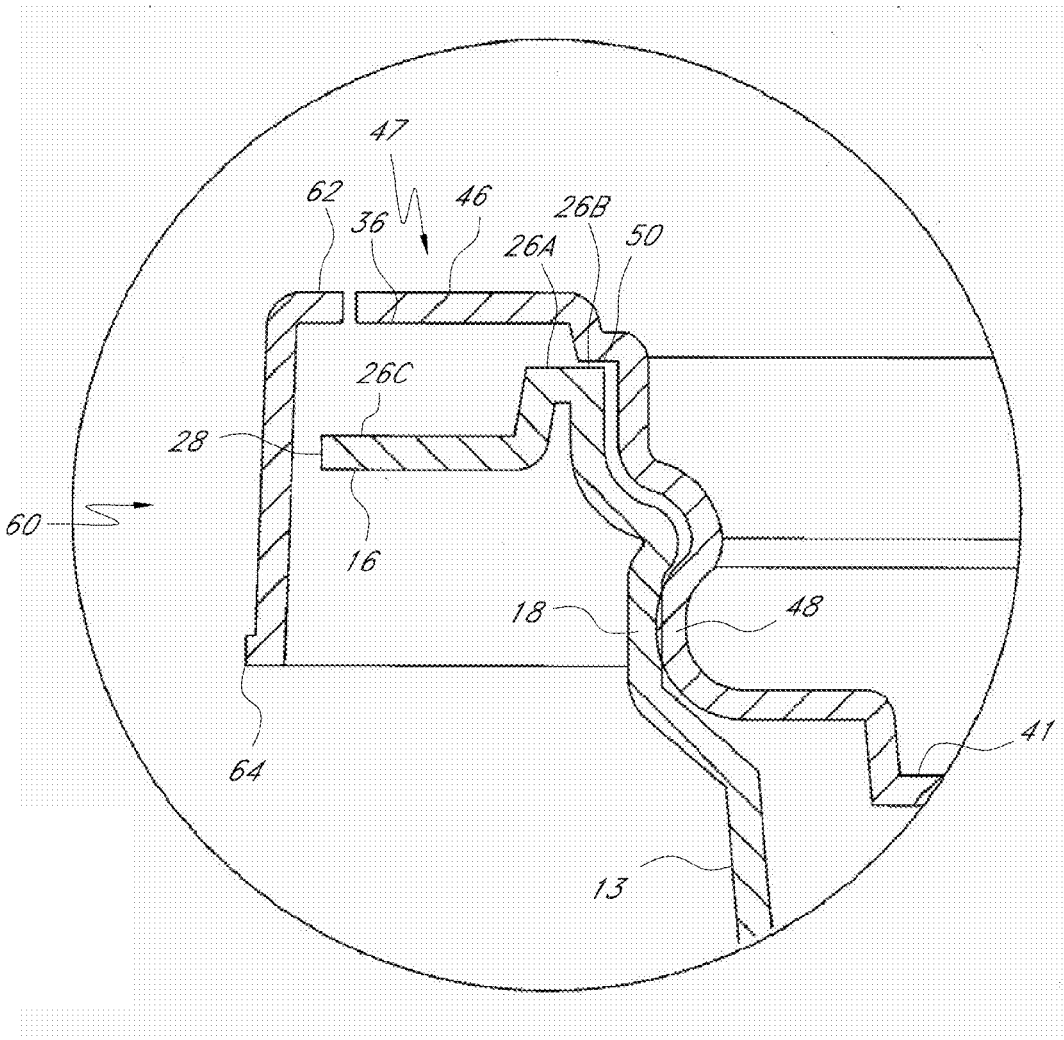
FIG. 4D is an enlarged view of the container system of 4B at 4D-4D.
Figure 4E:
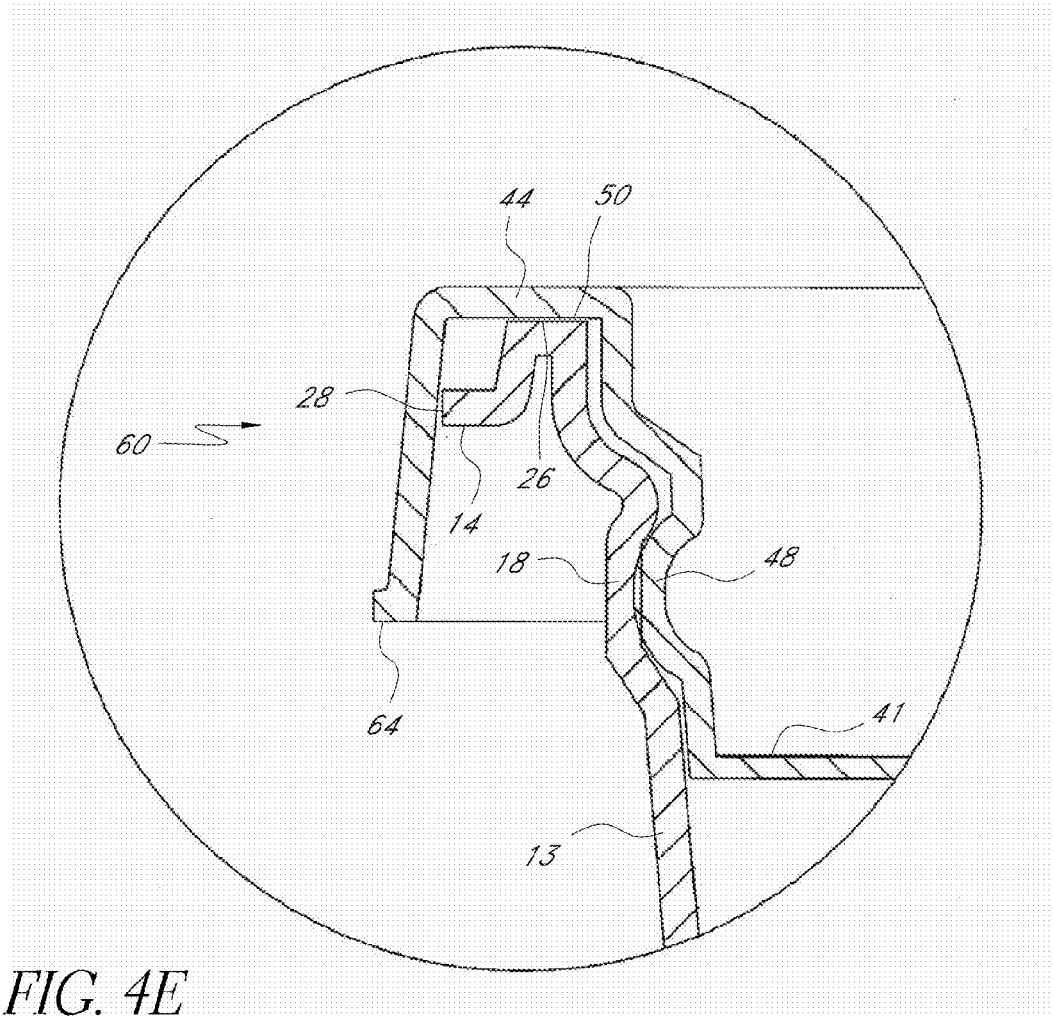
FIG. 4E is an enlarged view of the container system of 4C at 4E-4E.

As best depicted in FIGS. 4D and 4E, the lid 40 and base 10 can combine to form a snap-fit seal near their peripheries. FIGS. 4D and 4E depict such features near the corners and the sides, respectively. Although the features related to sealing are substantially the same between these regions in the depicted embodiments, in other embodiments they can vary. For example, in some embodiments it may be desirable to provide a stronger seal along the walls and a weaker seal near the corners, to facilitate opening of the container system 1 at a desired location.

As depicted, the base 10 can include a sealing section 18 along the side wall 13. The sealing section can be formed by a portion of the side wall 13 expanding outwardly as it extends upward, forming a lower-boundary or engagement surface for the sealing section 48 of the lid 40. The sealing section 18 of the base 10 can then form a generally central undercut, where the sealing section 48 of the lid 40 can extend into and press against the base 10. The sealing section 18 of the base 10 can then extend back inward, forming an upper-boundary or engagement surface for the sealing section 48 of the lid 40. The lid sealing section 48 can have similar features as the base sealing section 18, forming an outwardly-extending protrusion. The two sections 18, 48 can then come together to form a snap-fit connection, wherein at least one of the sections deflects to come into the sealed arrangement depicted. The engagement surfaces can be generally continuous and facilitate the formation of a seal. Alternatively (or additionally) the seal can be formed in the central section of the sealing sections 18, 48. In either case, in the depicted embodiment a snap-fit connection can be formed that additionally provides a seal. When the seal extends around the entire periphery of the container system 1, the space within the container can be isolated from the ambient atmosphere by a liquid and/or gas tight seal. Advantageously, the depicted embodiment can also be reclosable and resealable.

In other embodiments, details of the sealing and snap-fit may vary. For example, in some embodiments the direction of the protrusions can be reversed. Further, in some embodiments the form of the seal can vary along the periphery of the container system 1. Even further, in some embodiments a complete, liquid and/or gas tight seal might not be formed, such as where venting is provided. A variety of additional variations are possible and contemplated in the embodiments of the invention. For example, in some embodiments there can be a seal that does not snap-fit or vice versa, or the sealing and snap-fit functionality can arise from separate structures.

As discussed above, the lid 40 and the base 10 can also include flanges 14, 16, 44, and 46. As depicted in FIG. 4D, the corner flanges 16, 46 can be separated. In the depicted embodiment, the separation can be formed by the flanges being raised (lid) and lowered (base) outwards from their respective contact surfaces 50, 26. The contact surfaces 50, 26 of the lid 40 and base 10 can generally limit the translation of the lid 40 into the base 10. Further, the contact surface 26 on the base 10 can provide support to the lid 40, preventing a lower lid 40 from excessive deflection or breaking when bearing a load from above. The contact surfaces 50, 26 can further be configured to support the lid 40 sufficiently to withstand application of the lid 40 to the base 10 during an automated machine process. Although the contact surfaces 50, 26 are depicted as being horizontal, in other embodiments they can be angled, curved, vertical, or otherwise.

As further depicted, the lid corner flange 46 can be raised from the lid contact surface 50, and the base corner flange 16 can generally be lowered, creating a distance between the lid corner flange 46 and the base corner flange 16, and also forming a lower contact surface 26C accessible for opening by, e.g., a human finger. Comparing with FIG. 4E, in which only the lid flange 14 is lowered and the lid flange 44 is not, there can be less space between the flanges along the sides as compared to the corners. Accordingly, in the depicted embodiment the corners can form a preferred place to grip, potentially to open the container system 1 by pulling the lid 40 and the base 10 apart.

Additionally, comparing FIGS. 4D and 4E indicates that the area of contact between the contact surfaces 50, 26 of the lid 40 and base 10 can vary between the corners and other regions. As depicted in FIG. 4D, the base 10 can include two up-facing surfaces 26A, 26B, of which only 26B contacts the contact surface 50 of the lid 40. However, in FIG. 4E the entire base contact surface 26 can interact with the lid contact surface 50 along the edges of the container. In other embodiments, the relations between the contact surfaces can vary in other ways. Further, although the depicted contact surfaces are generally flat, in other embodiments they can comprise other shapes. Additionally, as depicted, the lid 40 can include contact surfaces, such as the down-facing contact surface 36 generally opposite the separate contact surfaces 26A, 26C on the base 10.

Figure 4G:
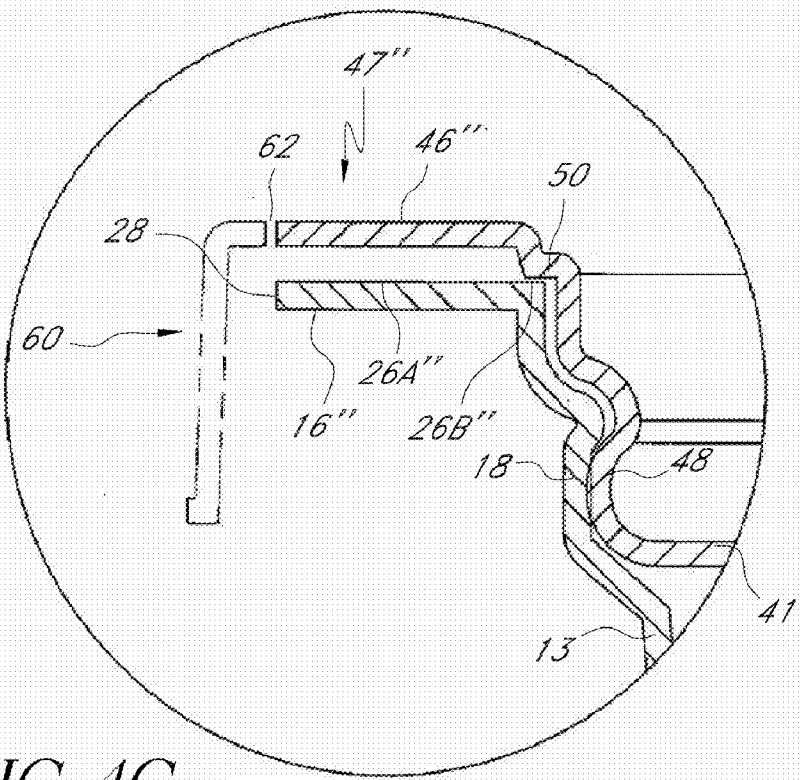
FIG. 4G is an enlarged view of another alternative embodiment of a container system, corresponding to FIG. 4D.
Figure 4F:
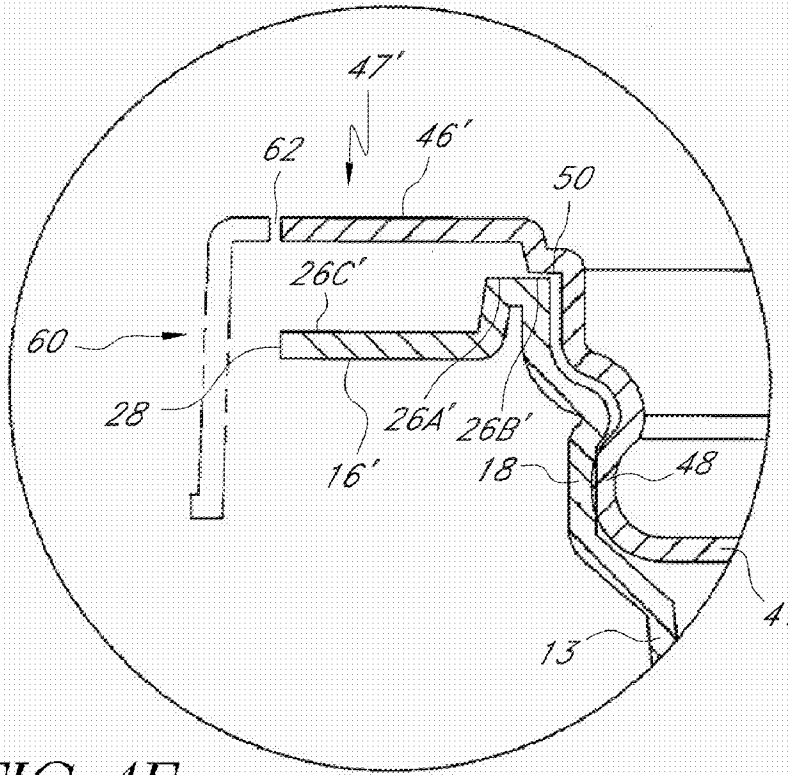
FIG. 4F is an enlarged view of an alternative embodiment of a container system, corresponding to FIG. 4D.

FIGS. 4F and 4G depict alternative embodiments of the lid 40 and base 10 at the corner portion (corresponding with FIG. 4D). As depicted in the embodiment of FIG. 4F, both the lid and base corner flanges 46', 16' can be raised/lowered. Differing from FIG. 4D, the corner flanges 46', 16' can both extend a greater distance, further facilitating their gripping and separation. As depicted in the embodiment of FIG. 4G, the base corner flange 16" can be non-lowered, or at the same vertical position as the contact surface 26". Thus, the distance between the lid and base corner flanges 46", 16" can be reduced. Although the embodiments depicted in FIGS. 4D-4F are described as depicting corner or non-corner positions, in other embodiments their locations can vary.

As further depicted in the Figures, the lid 40 can attach to a band 60. As best shown, the band 60 can be a closed band, forming a complete loop and/or having an annular structure. Advantageously, a complete loop can require fewer cuts or similar steps to form the band 60. Further, the entire band 60 can be removed at once, as further described below. The band can attach to the lid 40 at a tear line depicted as a perforated end 62. In some embodiments the attachment points can be point-attachments, facilitating tearing at these points. However, in other embodiments the band 60 can attach to the lid 40 by other means, such as at a weakened portion, a portion of thinned material, a groove, adhered to, bonded to, or other structures that can form a tear line. The band 60 can be removable from the lid 40 by a variety of means such as tearing, pulling, shearing, cutting, detaching, etc. As depicted in FIGS. 4D-4G, the band 60 can extend downward from the lid 40 and substantially block access to the free end 28 of the base 10. Further, as the band 60 can extend completely around the periphery of the lid 40 and base 10, it can block access to the entire free end 28 of the base. Thus, while the band 60 is in place a user's fingers cannot easily access the flanges 14, 16 of the base 10. Thus, the base 10 cannot be easily gripped, only its side walls 13 and bottom 11 being generally available. Further, the lid 40 cannot be easily gripped because its periphery is attached to the band 60, leaving only its upper side available.

As a result of this configuration, the container system 1 cannot be easily opened while the band 60 is in the depicted position. However, the band 60 can be removable from the lid 40 and can have a free end 64 that can be easily accessible. Thus, one can grasp the free end 64 of the band 60 and pull it from the lid 40, exposing the flanges of the lid 40 and base 10 and allowing opening of the container system 1. Advantageously, the band 60 can be substantially symmetrical with no specific tab to pull. Thus, the band 60 can be removed from any side. The symmetry also allows a label to be applied to any side wall 13 without need to identify which side should be a "front" or "back".

It will be noted that additional embodiments of this design are contemplated herein. For example, in some embodiments the band 60 can attach to the base 10 instead of the lid 40. In such cases, the band 60 can extend upward, preventing access to a lid free end. In other embodiments, portions of the flanges 14, 16, 44, 46 of the lid 40 and base 10 can be too close together for a person to easily grasp there between. In such embodiments, the band 60 can extend over only a portion of the periphery. As another example, in some embodiments the band 60 can attach to both the lid 40 and the base 10, even though in the depicted embodiments the band 60 is not attached to the base 10. It will be clear from the description herein that a wide variety of additional forms of the band 60 are possible.

Figure 8:
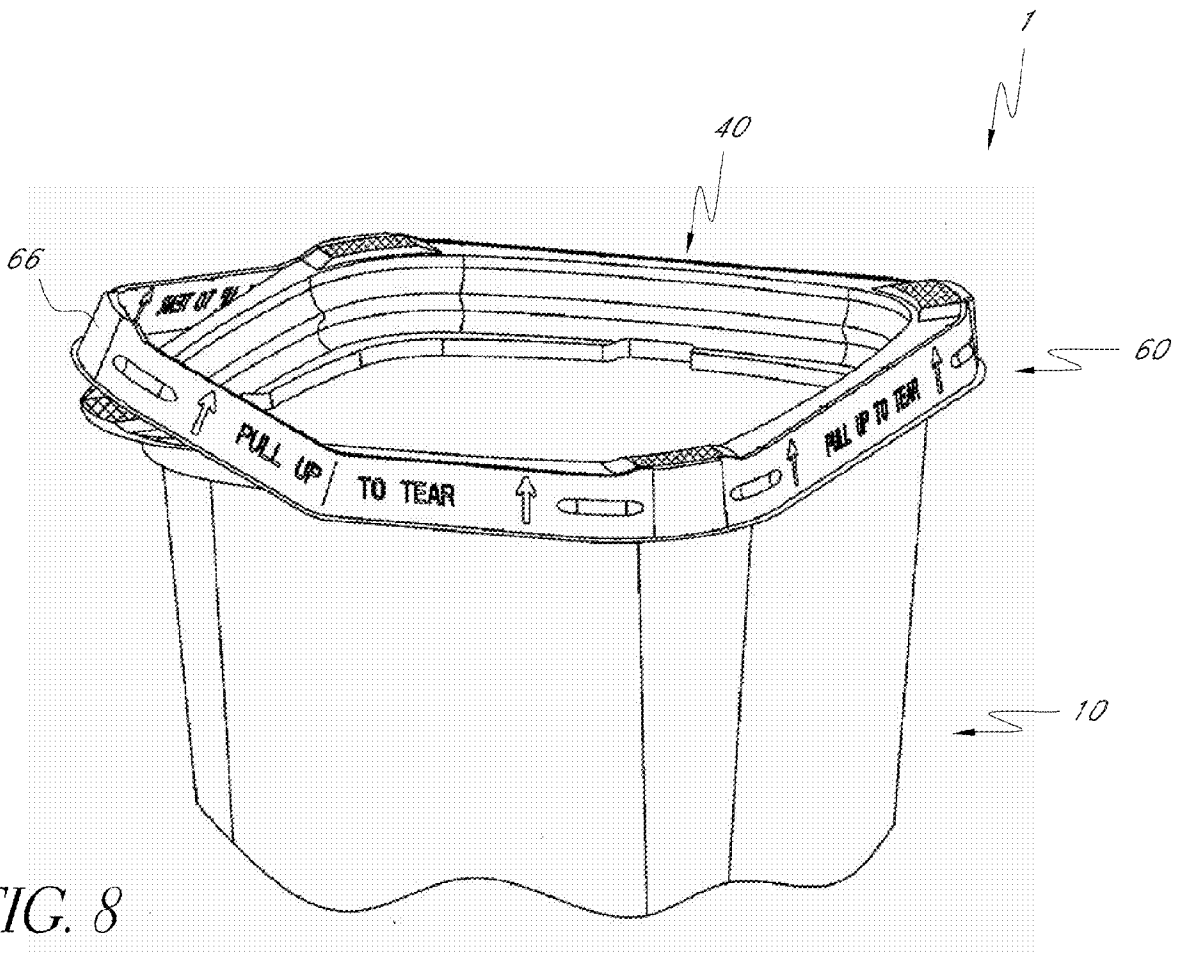
FIG. 8 is a perspective view of the container system of FIG. 1 in a partially opened position.
Figure 8A:
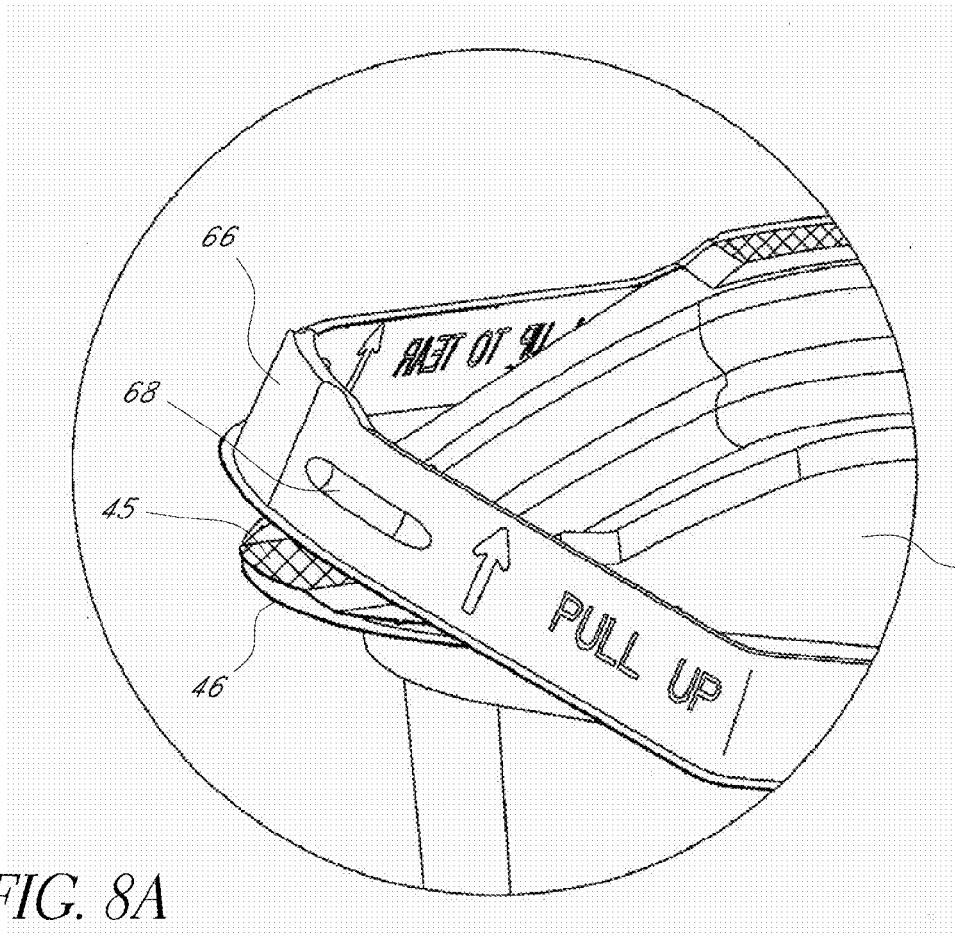
FIG. 8A is an enlarged view of the container system of FIG. 8.

Further, as depicted, the band 60 can attach to the lid 40 only in particular areas. For example, as depicted in FIGS. 4 and 4D, the band 60 can be generally detached from the lid 40 near the corners (while attached elsewhere, as depicted in FIG. 4E). This can result from the attachment between the band and the lid being pre-cut at or near the corners, or at a removed portion as further described herein (i.e. when the container is generally round). Thus, the band 60 can be easily grasped and pulled away from the lid 40 at the corners. As depicted in FIG. 8, this can facilitate removal of the band 60 by pulling it upward sufficiently to separate the band 60 from the lid 40 by pulling it with one hand and the side walls 13 of the base 10 with another hand. Alternatively, pulling up the band 60 at a corner can expose enough of the lid or base corner flanges 16, 46 to allow one to grasp one of those to help separate the band 60. Notably, as depicted in FIG. 8, the entire band 60 need not be removed. Instead, in some embodiments it can be sufficient to only tear the band 60 at a corner. Further, in such embodiments the band 60 can be firmly bonded along the remaining border with the lid 40, such that the band 60 only tears near the corner. Alternatively, in some embodiments the band 60 can be unattached to the lid 40 near the corner. For example, in embodiments where the band 60 is initially integral with the lid 40, the join line along the perforated end 62 of the band 60 can have a cut-out near the corner such that they are unattached in that region. Thus, the band 60 can be more easily lifted near the corner.

More particularly, in some embodiments where the band 60 remains partially attached to the lid 40, the band can be tearable along a specific portion of the length of the band-lid connection. For example, the band 60 can be tearable along approximately ⅕ of the length. Further, to prevent the lid 40 and base 10 from separating prior to the tearing of the band 60, they can require a specific force to separate greater than the force necessary to tear the band. For example, the lid 40 and base 10 can require a force of at least approximately 0.2 pounds to separate.

It should be noted that the band 60 can include a raised portion similar to the raised portion 47 of the lid 40 near its corners. Thus, the band 60 can generally match the periphery of the lid 40 while providing a flat free end 64. As depicted, the free end 64 of the band 60 can include an outwardly extending flange, facilitating gripping of the band 60.

Further, to prevent unintended opening of the container system 1, the band 60 can include corner locks 68. The corner locks 68 can be generally adjacent the corners of the band 60 and form inward extending, elongated protrusions that can interact with the flange 44 of the lid 40. The corner locks 68 can engage the flange 44 from below, generally hindering upward movement of the band 60 relative to the lid 40 near the corners. Thus, even though the band 60 might not be connected to the lid 40 near the corners, the corner locks 68 can prevent unintended relative movement. In some embodiments, the corner locks 68 can have slightly different forms and/or be positioned at different points.

Additionally, in some embodiments the corner locks 68 can hinder opening of the container system 1 without tearing the container. For example, in some embodiments the band 60 can be detached from the lid 40 near the corners. Further, as described above, the lid 40 and base 10 can be generally separated at the corners. Thus, in some embodiments it might be possible to lift the lid 40 and band 60 together near the corners to expose the base flange 14. In such embodiments, the container system 1 could possibly be opened without tearing. To make such unidentified opening more difficult, the corner locks 68 can be provided. The corner locks 68 can engage the base flange 14 requiring an outward bend to pass the base flange. Thus, a greater movement of the band 60 can be necessary to both rise up and bend outward around the base flange 14. This increased movement can be sufficient to induce severing of the band 60 from the lid 40 at least one point. This functionality can be particularly advantageous for embodiments such as that discussed above regarding FIG. 8, where the band 60 separates only at a corner.

Further, as depicted the band 60 can include indicia, indicating that one can "PULL UP TO TEAR" (or other language). The band 60 can also include directional indicators, further communicating a method for opening the container system 1.

Additionally, in some embodiments the band 60 can include additional tearable portions. For example, in some embodiments an annular band 60 can include a tear line that, upon tearing, converts the annular band into a strip. Further, in some embodiments this additional tear line can be configured not to tear upon detachment of the band 60 from the lid 40. However, in other embodiments the band 60 can be configured to remain as an annular band, with no additional tearable or frangible portions.

Figure 8C:
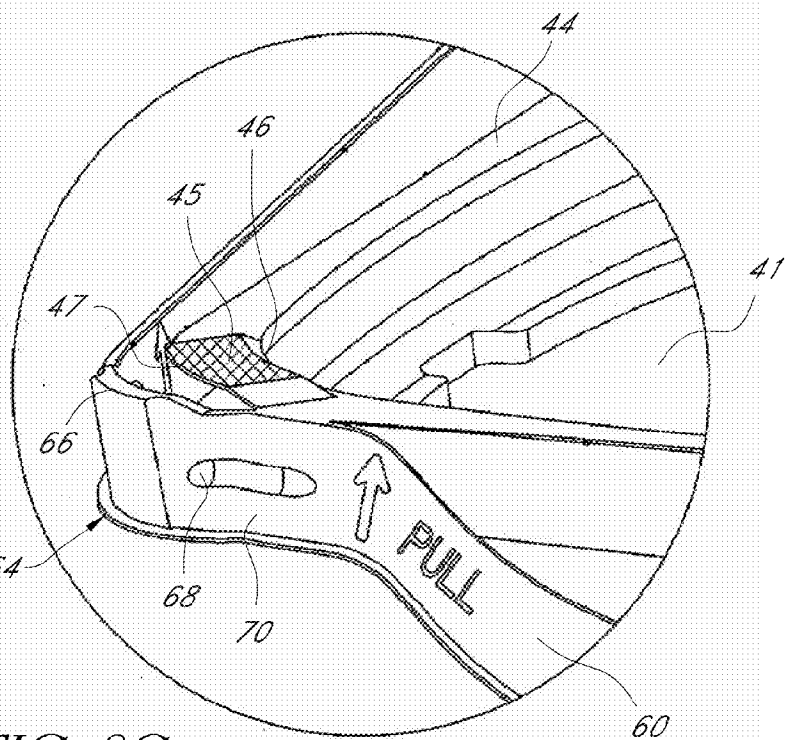
FIG. 8C is an enlarged view of another alternative embodiment of a lid, corresponding to FIG. 8A.
Figure 8B:
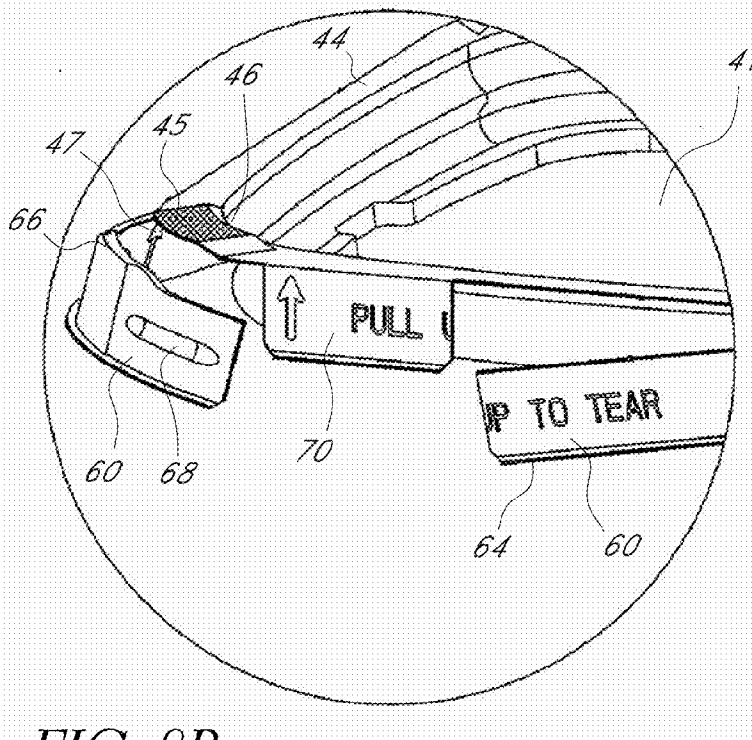
FIG. 8B is an enlarged view of an alternative embodiment of a lid, corresponding to FIG. 8A.

FIGS. 8B and 8C depict alternative bands 60 and their attachment to the lid 40. As depicted in FIG. 8B, the band 60 can have an attachment portion 70 that can remain attached to the lid 40. The band 60 can separate from the attachment portion 70, breaking the loop and leaving a portion behind. As depicted, the attachment portion 70 can span the entire width of the band 60 and be generally near the corner. However, in other embodiments its shape and location can vary. FIG. 8C depicts another band 60 with an attachment portion 70. However, in FIG. 8C the band 60 can remain closed, and attached to the lid 40. In both embodiments, at least a portion of the band 60 can remain attached to the lid 40 after it has been removed to ease opening of the container system 1. Advantageously, this can leave an indication that the container system 1 has possibly been previously opened. Absent said remaining portion, one might not realize that a band 60 ever was present, and thus not realize that the container system 1 may have previously been opened.

In one method of forming the container systems described above, a base 10 can be formed by molding, thermoforming, or the like. Further, the lid 40 and band 60 can be formed integrally in a similar manner. Perforations between the band 60 and the lid can then be cut with a cutting tool, laser, or otherwise. Advantageously, the lid 40 and band 60 can be modular with respect to the base 10, allowing different sized bases 10 to be used with any given lid/band combination.

The bases 10 can then be loaded with a desirable product such as food, spices, drugs, hygiene products, chemicals, etc. The lid 40 (along with the band 60) can then be snap-fit onto the base 10, providing a secure connection and in some embodiments a seal. At this point, the container system 1 is closed and the band 60 indicates that has likely not been opened since its initial closing.

As described above, one can then open the package by gripping a corner of the band 60 and lifting it upwards to tear it from the lid 40. Once the band 60 is sufficiently removed to expose the flanges of the lid and base, those flanges can be pulled apart to open the container system 1. If desired, the container system 1 can be reclosed, with the torn band 60 indicating the prior activity.

Reference throughout this specification to "some embodiments" or "an embodiment" means that a particular feature, structure or characteristic described in connection with the embodiment is included in at least some embodiments. Thus, appearances of the phrases "in some embodiments" or "in an embodiment" in various places throughout this specification are not necessarily all referring to the same embodiment. Furthermore, the particular features, structures or characteristics may be combined in any suitable manner, as would be apparent to one of ordinary skill in the art from this disclosure, in one or more embodiments.

In the above description of embodiments, various features of the inventions are sometimes grouped together in a single embodiment, figure, or description thereof for the purpose of streamlining the disclosure and aiding in the understanding of one or more of the various inventive aspects. This method of disclosure, however, is not to be interpreted as reflecting an intention that any claim require more features than are expressly recited in that claim. Rather, inventive aspects lie in a combination of fewer than all features of any single foregoing disclosed embodiment.

Although the invention(s) presented herein have been disclosed in the context of certain preferred embodiments and examples, it will be understood by those skilled in the art that the invention(s) extend beyond the specifically disclosed embodiments to other alternative embodiments and/or uses of the invention(s) and obvious modifications and equivalents thereof. Thus, it is intended that the scope of the invention(s) herein disclosed should not be limited by the particular embodiments described above.

What is claimed is:

1. A container comprising:

a base defining a space and an opening at a periphery, the opening comprising at least one outwardly extending base flange, the flange comprising a contact surface, and the base further comprising a base sealing section;

a lid defining a shape that generally matches the opening of the base generally at a periphery of the lid, the lid comprising at least one outwardly extending lid flange comprising a contact surface at the periphery and a lid sealing section, where the lid sealing section and the base sealing section can together form a continuous reclosable snap fit connection when the lid is forcibly applied to the opening of the base to generally close the opening, and where the base flange and lid flange can be in at least approximate alignment when the opening is closed, and where the lid and base flanges can be manually pulled apart to separate the lid and base and overcome the snap fit, at least one of the lid or base flanges further comprising a removed portion to create an increased distance between corresponding contact surfaces of said lid and base flanges at least one region;

a tamper-evident, annular closed band attached at a first end to one of the base and lid substantially along its entire periphery and having a free end at a second end, the tamper-evident band being at least partially detachable from the base or lid as a closed band, and extending to block direct manual access to the lid and base flanges, wherein the lid and band are generally raised at the removed portion.

2. The container of claim 1, wherein the lid and base form a generally continuous seal and the container is resealable.

3. The container of claim 1, wherein the band is attached to the lid by at least one of a plurality of point-attachments, a weld, or a bond.

4. The container of claim 1, wherein the band is substantially symmetrical.

5. The container of claim 1, wherein the band's attachment is pre-cut through at the removed portion.

6. The container of claim 1, wherein the container comprises interengaging features on the lid and base such that multiple units of the container can stably stack.

7. The container of claim 1, wherein an additional space is provided between the lid and base flanges.

8. The container of claim 1, wherein a space between the base flange and the lid flange is greater than the removed portion.

9. The container of claim 1, wherein the container comprises one or more corners and the band is initially disconnected from both the lid and base near at least one of said corners.

10. The container of claim 9, wherein the band can be removed from the container by pulling at least one of said corners.

11. The container of claim 1, wherein the band is symmetric.

12. The container of claim 1, wherein the base and lid comprise flat contact surfaces that can transmit excess weight when the container is stacked.

13. The container of claim 12, wherein the contact surfaces extend about the entire periphery.

14. The container of claim 1, wherein the removed portion is a raised portion of the lid flange.

15. The container of claim 1, wherein the removed portion is a raised portion of the base flange.

16. The container of claim 1, wherein the removed portion is at a corner region.

17. The container of claim 16, wherein each corner of the container has a removed portion.

18. The container of claim 16, wherein the lid and base flanges are generally adjacent outside the corner regions.

19. The container of claim 1, wherein the band is attached to the lid at a corner region.

20. The container of claim 1, wherein the force required to detach the band from the lid is less than the force required to overcome the snap fit between the lid and base.

21. A container comprising:

a base defining a space and an opening at a periphery, the opening comprising at least one outwardly extending base flange and the base further comprising a base snap-fit portion;

a lid defining a shape that generally matches the opening of the base generally at a periphery of the lid, the lid comprising at least one outwardly extending lid flange at the periphery and a lid snap-fit portion, such that the base snap-fit portion and the lid snap-fit portion can together form a snap fit when the lid is forcibly applied to the opening of the base to generally close the opening, and such that the base flange and lid flange can be in at least approximate alignment when the opening is closed such that the lid and base flanges can be manually pulled apart to separate the lid and base and overcome the snap fit; and a tamper-evident band attached at a first end to one of the base and lid substantially along its entire periphery and having a free end at a second end, the tamper-evident band extending to block direct manual access to the lid and base flanges, and being detachable from the base or lid such that a majority of the lid and base flanges can be exposed upon detachment but the band can remain partially attached to one of the base and lid and the and can sever into a strip near the remaining partial attachment.

22. The container of claim 21, wherein the base and the lid require at least 0.2 lb of force to separate said lid apart from said base.

23. The container of claim 21, wherein the base and lid contact surfaces are oriented horizontally.

24. The container of claim 21, wherein the tamper-evident band comprises a textured gripping surface.

25. A container comprising:

a base defining a space and an opening at a periphery, the opening comprising at least one outwardly extending base flange and the base further comprising a base snap-fit portion;

a lid defining a shape that generally matches the opening of the base generally at a periphery of the lid, the lid comprising at least one outwardly extending lid flange at the periphery and a lid snap-fit portion, such that the base snap-fit portion and the lid snap-fit portion can together form a continuous reclosable snap fit connection, when the lid is forcibly applied to the opening of the base to generally close the opening, and such that the base flange and lid flange can be in at least approximate alignment when the opening is closed such that the lid and base flanges can be manually pulled apart to separate the lid and base and overcome the snap fit; and a tamper-evident band attached at a first end to the lid substantially along its entire periphery and having a free end at a second end, the tamper-evident band being at least partially detachable from the lid at least a separating portion, and extending to block direct manual access to the lid and base flanges, the band further comprising two or more inward protrusions that abut the base flange at said separating portion at least when the band is pulled upward from the base.

26. The container of claim 25, wherein the band is detachable from the lid only at the separating portion.

27. The container of claim 25, wherein movement of the protrusions beyond the base flange necessitates a tearing of the band from the lid.

28. The container of claim 25, wherein the separating portion is at a corner portion of the container.

29. A container comprising:

a base defining a space and an opening at a periphery, the opening comprising at least one outwardly extending base flange and the base further comprising a base snap-fit portion, the base and the opening defining a polygonal shape;

a lid defining a shape that generally matches the opening of the base generally at a periphery of the lid, the lid comprising at least one outwardly extending lid flange at the periphery and a lid snap-fit portion, such that the base snap-fit portion and the lid snap-fit portion can together form a continuous horizontal snap fit when the lid is forcibly applied to the opening of the base to generally close the opening, and such that the base flange and lid flange can be in at least approximate alignment when the opening is closed such that the lid and base flanges can be manually pulled apart to separate the lid and base and overcome the snap fit; and a tamper-evident band attached at a first end to the lid substantially along each of its sides and unattached at least one corner portion, and the tamper-evident band having a free end at a second end, the tamper-evident band being at least partially detachable from the lid, and extending to block direct manual access to the lid and base flanges, the band further comprising two or more inward protrusions that abut the base flange at said corner portion at least when the band is pulled upward from the base.

30. A container lid configured to form a snap-fit with a base, the container lid comprising:

a broad central portion;

a snap-fit portion at a periphery of the broad central portion, configured to form a snap-fit with a base;

a lid flange outward from the snap-fit portion, the lid flange comprising one or more raised portions at a corner of the lid flange; and a detachable skirt attached to the lid flange along the periphery of the container lid, the skirt comprising one or more inward protrusions, wherein the skirt is detachable from the lid as a closed, annular band.

31. The container lid of claim 30, wherein the skirt extends at approximately a 90 degree angle relative to the flange such that the skirt can obscure a base flange to which the lid may be applied.

32. The container lid of claim 30, wherein the skirt attaches to the lid by at least one of a series of perforations, an adhesive, or a weld.

33. The container lid of claim 30, wherein the annular band comprises a tear line that, upon tearing converts the annular band into a strip.

34. The container lid of claim 30, wherein the skirt is detachable from the lid only at one or more corner portions.

35. The container lid of claim 30, wherein a portion of the skirt can be untearable from the lid flange.

36. The container lid of claim 35, wherein the skirt can sever from the untearable portion such that the remaining portion of the skirt can be completely detached from the lid flange.

37. The container lid of claim 30, wherein the band comprises indicia.

38. A method of forming a container comprising:

forming a base defining a space, a periphery, an opening at the periphery, and a base snap-fit portion, wherein the opening comprises at least one outwardly extending base flange;

forming a lid shaped to match the opening at the periphery and comprising at least one outwardly extending lid flange at the periphery and a lid snap-fit portion; and cutting a series of perforations in the lid to form a tamper-evident band encircling a periphery of the lid and having a free end at the second end, the tamper-evident band being at least partially detachable from the lid at least a separating portion;

forcibly applying the lid to the base to close the opening and bring the two sealing portions adjacent each other to form a reversible seal;

wherein the tamper-evident band extends to block direct manual access to the lid and base flanges, and wherein the band further comprises two or more protrusions that abut the base flange at the separating portion at least when the band is pulled upward from the base.

39. The method of claim 38, wherein the base and the lid comprise corners and the step of cutting does not leave any attachment between the band the respective base or lid at the corners.

40. The method of claim 38, wherein the base and the lid form a reversible snap-fit.

41. The method of claim 38, wherein the step of applying the lid first portion to the base is performed by a machine.

42. The method of claim 41, wherein the steps of forming further comprise forming generally planar contact surfaces on both the base and the lid that come into contact during the applying step to provide substantial structural support against forces applied on the container during the applying step.

43. A container comprising:

a base defining a space and an opening at a periphery, the opening comprising at least one outwardly extending base flange, the flange comprising a contact surface, and the base further comprising a base sealing section;

a lid defining a shape that generally matches the opening of the base generally at a periphery of the lid, the lid comprising at least one outwardly extending lid flange comprising a contact surface at the periphery and a lid sealing section, where the lid sealing section and the base sealing section can together form a continuous reclosable snap fit connection when the lid is forcibly applied to the opening of the base to generally close the opening, and where the base flange and lid flange can be in at least approximate alignment when the opening is closed, and where the lid and base flanges can be manually pulled apart to separate the lid and base and overcome the snap fit, at least one of the lid or base flanges further comprising a removed portion to create an increased distance between corresponding contact surfaces of said lid and base flanges at least one region;

a tamper-evident, annular closed band attached at a first end to one of the base and lid substantially along its entire periphery and having a free end at a second end, the tamper-evident band being at least partially detachable from the base or lid as a closed band, and extending to block direct manual access to the lid and base flanges, wherein the removed portion is a raised portion of the lid flange.

44. The container of claim 43, wherein the lid and base form a generally continuous seal and the container is resealable.

45. The container of claim 43, wherein the band is attached to the lid by at least one of a plurality of point-attachments, a weld, or a bond.

46. The container of claim 43, wherein the band's attachment is pre-cut through at the removed portion.

47. The container of claim 43, wherein an additional space is provided between the lid and base flanges.

48. The container of claim 43, wherein the container comprises one or more corners and the band is initially disconnected from both the lid and base near at least one of said corners.

49. The container of claim 48, wherein the band can be removed from the container by pulling at least one of said corners.

50. The container of claim 43, wherein the band is symmetric.

51. The container of claim 43, wherein the base and lid comprise flat contact surfaces that can transmit excess weight when the container is stacked, and further wherein the contact surfaces extend about the entire periphery.

52. The container of claim 43, wherein the band is attached to the lid at a corner region.

53. The container of claim 43, wherein the force required to detach the band from the lid is less than the force required to overcome the snap fit between the lid and base.

54. A container lid configured to form a snap-fit with a base, the container lid comprising:

a broad central portion;

a snap-fit portion at a periphery of the broad central portion, configured to form a snap-fit with a base;

a lid flange outward from the snap-fit portion, the lid flange comprising one or more raised portions at a corner of the lid flange; and a detachable skirt attached to the lid flange along the periphery of the container lid, the skirt comprising one or more inward protrusions, wherein a portion of the skirt can be untearable from the lid flange.

55. A container lid configured to form a snap-fit with a base, the container lid comprising:

a broad central portion;

a snap-fit portion at a periphery of the broad central portion, configured to form a snap-fit with a base;

a lid flange outward from the snap-fit portion, the lid flange comprising one or more raised portions at a corner of the lid flange; and a detachable skirt attached to the lid flange along the periphery of the container lid, the skirt comprising one or more inward protrusions, wherein the skirt is detachable from the lid only at one or more corner portions.

56. The container lid of claim 55, wherein the skirt can sever from the untearable portion such that the remaining portion of the skirt can be completely detached from the lid flange.

* * * * *

UNITED STATES PATENT AND TRADEMARK OFFICE

CERTIFICATE OF CORRECTION

PATENT NO. : 8,251,242 B2
APPLICATION NO. : 12/626476
DATED : August 28, 2012
INVENTOR(S) : Terry Vovan It is certified that error appears in the above-identified patent and that said Letters Patent is hereby corrected as shown below:

IN THE CLAIMS:

At column 14, line 36:

""least partially detachable from the lid at least a separating" should read

-- least partially detachable from the lid at at least a separating --

At column 15, line 2:

"substantially along each of its sides and unattached at" should read

-- substantially along each of its sides and unattached at at --

At column 16, line 8:

""the lid first portion to the base is performed by a machine" should read

-- the lid to the base is performed by a machine --

Signed and Sealed this
Fourth Day of December, 2012

David J. Kappos

David J. Kappos
*Director of the United States Patent and Trademark Office*